US005937599A

United States Patent [19]

Gerischer et al.

[11] Patent Number: 5,937,599

[45] Date of Patent: Aug. 17, 1999

[54] INTERIOR CONSTRUCTION SYSTEM FOR SANITARY AREAS

[75] Inventors: Wolf Gerischer; Angela Oedekoven-Gerischer, both of Düsseldorf, Germany

[73] Assignee: DORMA GmbH + Co. KG, Ennepetal, Germany

[21] Appl. No.: 08/756,307

[22] Filed: Nov. 25, 1996

[30] Foreign Application Priority Data

| | | | |
|---|---|---|---|
| Nov. 23, 1995 | [DE] | Germany | 195 43 611 |
| Nov. 23, 1995 | [DE] | Germany | 295 18 450 U |
| Nov. 24, 1995 | [DE] | Germany | 295 18 699 U |
| Nov. 24, 1995 | [DE] | Germany | 295 18 674 U |
| Dec. 19, 1995 | [DE] | Germany | 295 20 099 U |
| Dec. 19, 1995 | [DE] | Germany | 295 20 098 U |

[51] Int. Cl.[6] ..... E04B 1/00

[52] U.S. Cl. ..... 52/282.5; 52/277; 52/278; 52/282.1; 52/282.4; 52/469; 52/461; 52/465; 52/468

[58] Field of Search ..... 52/461, 465, 468, 52/476, 277, 282.3, 765, 57, 36.1, 34, 278, 282.1, 282.4, 469, 282.5; 49/425; 4/342, 662

[56] References Cited

U.S. PATENT DOCUMENTS

| | | | |
|---|---|---|---|
| 3,199,258 | 8/1965 | Jentoff et al. . | |
| 3,665,666 | 5/1972 | Delcroix | 52/461 |
| 3,733,759 | 5/1973 | Schulte et al. | 52/282.3 X |
| 3,751,737 | 8/1973 | Mustee | 52/36 X |
| 4,611,436 | 9/1986 | Williams | 49/425 |
| 4,689,930 | 9/1987 | Menchetti | 52/468 X |
| 5,155,952 | 10/1992 | Herwegh et al. | 52/461 X |
| 5,259,162 | 11/1993 | Nicholas | 52/468 X |
| 5,280,686 | 1/1994 | Davies | 49/425 X |
| 5,437,065 | 8/1995 | Sakawa | 52/34 X |
| 5,481,839 | 1/1996 | Lang et al. | 52/461 X |
| 5,655,346 | 8/1997 | Holmes et al. | 52/476 X |

FOREIGN PATENT DOCUMENTS

| | | |
|---|---|---|
| 2757759 | 6/1979 | Germany . |
| 3712777 | 11/1988 | Germany . |
| 4111707 | 11/1991 | Germany . |
| 9200161 U | 6/1992 | Germany . |
| 4307492 | 9/1994 | Germany . |
| 4409155 | 11/1994 | Germany . |
| 19508949 | 10/1995 | Germany . |

*Primary Examiner*—Carl D. Friedman
*Assistant Examiner*—Dennis L. Dorsey
*Attorney, Agent, or Firm*—Nils H. Ljungman & Associates

[57] ABSTRACT

Interior construction system for a sanitary area which has plate-shaped wall elements made of glass. The wall elements can be either straight or curved into a radius. The wall elements are connected positively and non-positively to a load-bearing element or stay pipe. Fastening locators on the stay pipe pass through a boring in the wall element and secure the wall element by the use of a fastener on the end of the fastening locator. A panel profile is attached to the stay pipe to conceal the joint formed by the wall elements. The panel profile has an enlarged cross-section at the end of its legs wherein a gasket resides in a groove and forms a seal at the wall elements. The interior construction system for a sanitary area has glass wall elements which are attached to stay pipes at differing angles. The joints of the wall elements on the stay pipes are hidden and sealed by panel profiles which are attached to the stay pipes. The stay pipes and glass wall plates can be arranged and sequenced to form differing structures within the sanitary area.

17 Claims, 15 Drawing Sheets

FIG. 9
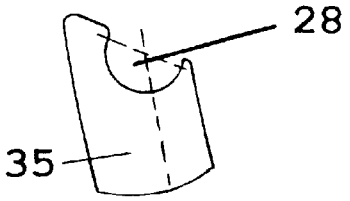
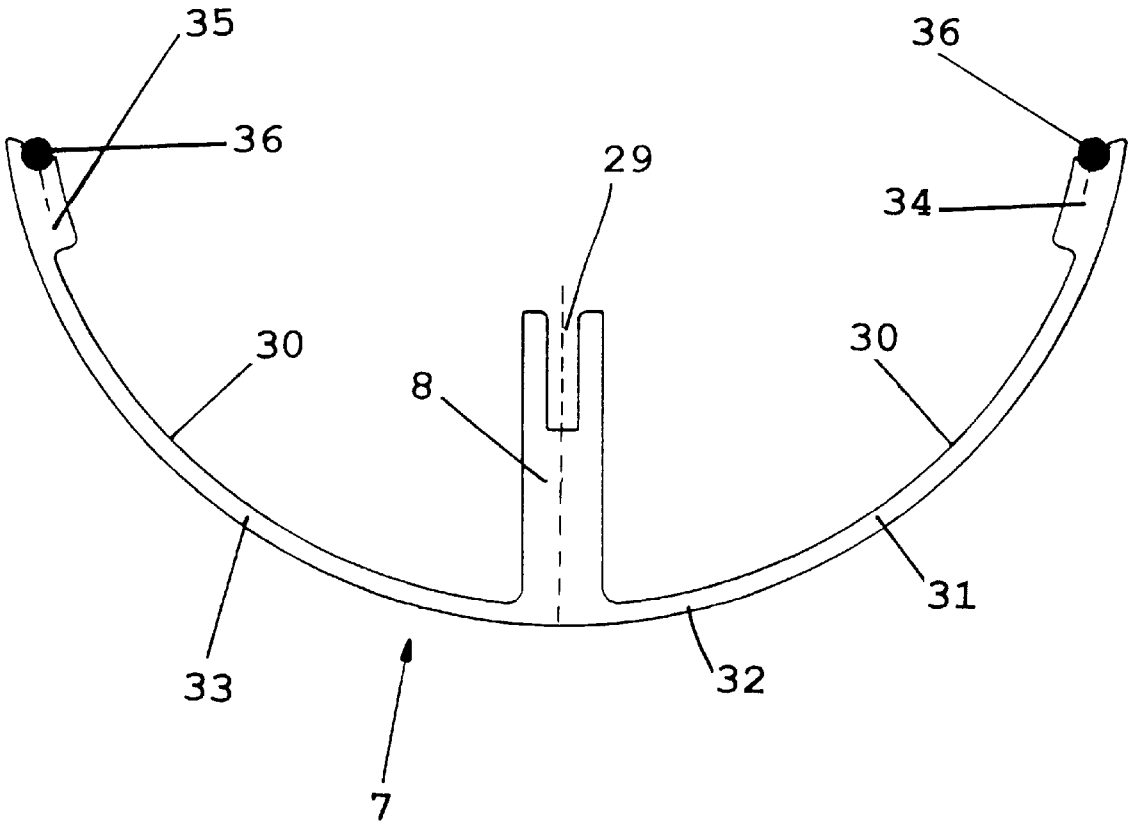
FIG. 8

INTERIOR CONSTRUCTION SYSTEM FOR SANITARY AREAS

BACKGROUND OF THE INVENTION

1. Field of the Invention

The present invention relates generally to an interior construction system for a type of connection and the connection of wall elements in the form of glass plates to stationary support elements in the form of tubular elements for sanitary areas.

2. Background Information

The fastening of wall elements made of glass requires particular care and special precautions so that as the glass wall elements are being installed, no stresses occur inside the wall elements which would result in damage to or destruction of the wall elements.

German Laid Open Patent Application No. 44 09 155 discloses a type of connection in which the front entry panels, made of all glass, are provided with an all-glass door and a stationary side part, and possibly also a skylight, in which the individual elements are connected to one another in discrete points by connecting elements. These connecting elements are designed so that they are inserted through a hole in the glass plates and a matching liner is placed on the opposite side. The two parts of the connecting element are either bolted or clipped together. As a result of the clamping action which is thereby achieved, the individual elements are fastened to one another, forming a positive and non-positive connection.

German Laid Open Patent Application No. 195 08 949 discloses a modular system for a support construction which uses profiles. In this case, two profile parts are used, and are connected to one another and held at a distance from one another by fastening elements. There is no panel covering of the support construction.

German Laid Open Patent Application No. 43 07 492 discloses a hollow profile which is used in the form of supports or stays. The profile, on the periphery, has grooves or depressions which run longitudinally and in which flat construction elements, panes of glass, etc. can be located.

German Patent No. 27 57 759 C2 discloses wall-mounted urinals which are made of a ceramic material or porcelain. These trough-shaped basins, which are open toward the front, are bolted onto a wall.

Another type of urinal which has a flushing device is described in German Utility Model 92 00 161. This urinal consists of an elongated urinal basin, and in the vicinity of the floor has an open collecting space for water and/or urine. This collecting space, which is open on top, is closed by a base surface which runs parallel to the floor, a rear wall surface, a front wall surface and lateral surfaces on each sides.

German Patent No. 41 11 707 A1 describes a partition for toilets, in particular for pissoirs or public urinals. This partition is used to improve the notorious problems posed for the user of the facility, including the fact that while using the toilet, any briefcases or similar items which are being carried must be put down within the user's sight. An additional objective of these partitions is to interrupt the line of sight to the adjacent urinal.

OBJECT OF THE INVENTION

The object of the present invention is to create a universal interior construction system which can be retrofitted in existing facilities, in particular in sanitary facilities. The supporting construction elements which are generally present in such systems do not adversely affect the overall appearance. The present invention also makes it possible to clean the sanitary areas easily and efficiently.

SUMMARY OF THE INVENTION

The present invention teaches that this object can be accomplished, in accordance with at least one preferred embodiment, by an arrangement in which plate-shaped wall elements, preferably made of glass, are either straight or are curved into a radius. Load-bearing supports, preferably in the form of tubular elements, in the form of stay pipes have fastening locators. The wall elements, which have borings located in the area of connection, are located on the fastening locators. Connecting elements are used in conjunction with the fastening locators to make positive and non-positive connections with the wall element. A panel profile, which has a cross section which follows a circular arc, has two legs which proceed from a retaining leg. Each leg has on the inside of its respective terminal areas an enlarged cross section. In the enlarged cross sections there is a recess for the location of a seal. On the inside of the panel profile there is at least one retaining leg which has a recess for the location of a fastening means, and the retaining leg in turn has fastening means which can be installed on a substructure to create an externally invisible, positive and non-positive connection with the substructure.

Stay pipes are used as load-bearing construction elements, whereby fastening locators are attached to the stay pipes, to fasten the glass wall elements between the stay pipes. This fastening can be either direct or indirect, but it is also possible, using a spacer ring, etc. or an installation clamp which is placed around the tubular element or stay pipe, to fasten these fastening locators directly or indirectly to the installation clamp. The installation clamp has the advantage, in that it must be possible to make adjustments for tolerances. The fastening locator is thereby configured so that it has a projecting edge which extends into a hole which is made in the plate-shaped glass wall element. It is thereby possible to fix the plate-shaped wall element in position as it is being installed. But so that the wall elements also remain in this position, a fastener is applied from outside. The fastener then enters into a positive and non-positive connection with the fastening locator, and simultaneously clamps the glass pane of the wall element in between. As a function of the size of the wall element, a plurality of these fastening locators must then be attached to such a stationary tubular element, over the entire length of the tubular element. If an installation clamp is used, this installation clamp must also be connected to the existing tubular element.

In other words, the projecting edge of the fastening locator extends through a hole in the plate-shaped glass wall element and receives a fastener. The projecting edge of the fastening locator does not come into contact with the inside perimeter of the hole in the plate-shaped glass wall-element when the fastener is secured in place. The plate-shaped glass wall element is held in place between the fastening locator and the fastener by tightening the fastener onto the projecting edge of the fastening locator.

As a result of this method of fastening the panels in practically one spot, it is possible to attach wall elements which run straight, but also to use wall elements which are curved in an arc of any desired radius, or are in the shape of a polygon, which causes major problems in similar known systems. At the same time, as a result of the use of the fastenings, which are realized so that they are smooth on the outside, there is no longer any need to use the conventional fastening elements. This means that the overall appearance is more aesthetically appealing to an observer. These relatively small fasteners are almost unnoticed by the observer and do not interfere with the overall impression.

It is also irrelevant whether the tubular elements consist of round tubes, square tubes, rectangular tubes or tubes of any other shape. The surfaces of these tubes can also be finished before the installation of the wall elements, which means that no subsequent finishing activities are necessary.

On two curved wall elements which are to be connected to one another, for example, and are fastened to a tubular element, this joint area can also be covered by a panel profile, so that the fastening of the wall elements is not visible.

In other words, the panel profile is used to conceal the attachment of the wall elements to the tubular element and to conceal the joint formed by the intersection of the wall elements.

The panel profile claimed by the present invention is created so that it has a cross section which follows a curve to cover curved wall elements. The invention does not specify that the shape in question must necessarily be a curve; the shape can also be a polygon. In this case it is always important to note that the panel profile can be adapted to local conditions. For the sake of simplicity, the following description relates exclusively to a circular curved panel profile, although any other curved or polygonal shape is also conceivable.

The panel profile consists of a light alloy profile which has two thin bent legs or webs which converge on a retaining leg. In the terminal area of the legs, the cross section is enlarged to hold seal elements. For this purpose, there are indentations or depressions in the enlarged cross section which make it possible to insert an elastic seal or gasket at this point.

So that the panel profile can be invisibly installed on the construction elements located beneath it, on the inside of the panel profile, i.e. on the concave side, there is a retaining leg, the purpose of which is to be connected to fastening elements which are on the construction element. The connection can thereby be in the form of a screwed connection, a plug-in connection or a clip connection. Care must be taken, however, that in the corresponding type of connection, sufficient pressure is exerted on the legs of the panel profile which are on both sides of the retaining leg, to simultaneously bring the gasket or seal in the terminal region into contact with the corresponding wall elements, and thus to create a seal.

In an additional embodiment of the present invention, the panel profile can also be used to connect additional profiles at this point. These profiles, for example, can be ones which hold a panel to divide off certain areas.

As a result of the circular shape of the panel profile, it is possible to use it to cover all different types of construction elements, including for example wall elements at all sorts of angles, i.e. which do not run in a straight-line facade. It is also possible that the legs of the panel profile, starting from the retaining leg, have different dimensions. The long panel profile can thereby be adapted by means of corresponding color coordination to the other visible parts of a construction or of the wall elements.

The panel profile can be manufactured preferably as a long, light alloy profile.

The combination of an invisible connection of the fasteners and a visible connection of the fastener elements is conceivable, in which case the fastening element is also and simultaneously covered by the panel profile, which fastening element is preferably realized in the form of a screw element with a screw head.

In an additional embodiment of the present invention, it is also possible to connect stationary side parts or movable panels or leaves or doors to the existing tubular elements. Such movable panels can be attached by using a door frame on the upper part of the elements, in an entry area. Inside the door case or frame are the fastening elements for the stationary side part which can be directly attached by means of its vertical edge to a stationary tubular element. The movable panel is then connected by means of a runner rail which is also installed in the door frame so that it is not visible to the observer. The movable panel can be moved on this runner rail. This movement can be either in a straight line or along a curved path. Such a movable panel can be set in motion either manually or by means of a corresponding automatic drive mechanism.

The automatic drive mechanism can preferably be an electro-mechanical drive mechanism which opens and closes the door in response to a sensor signal.

As a result of the above-mentioned connection and type of attachment of glass wall elements to existing stationary tubular elements, the attachment which is created is aesthetically attractive. There are no externally projecting profiles and fasteners which adversely affect the appearance. It can therefore be said that in this area, the connections used for the fixtures for the sanitary or bathing cubicles, which can be used as a shower, toilet or changing cubicles or for other similar applications, have been made practically invisible.

The present invention teaches that it is possible for the sanitary installation wall to consist of a varying number of similar elements which can be combined and arranged in any desired order. The individual elements thereby consist of plate-shaped glass panels which are in the shape of a polygon or a circular arc. These elements are preferably made of glass. The glass is thereby structured, and on the reverse side can be made opaque by the application of a screen printed pattern, a film or a coating.

On account of the smooth, closed surface of the wall elements which are made of glass, there is a sturdy surface which is easy to keep clean. So that no water can penetrate in the vicinity of the panel profiles, the panel profiles are provided in their terminal area with seals which make possible a clean edge on the wall element.

The wall elements are thereby bent in a concave fashion, while the connecting elements have a convex bend at the connection points. The wall elements are designed so that there are openings or holes in them which make it possible to attach sinks, consoles, soap dispensers and faucets. The sinks and consoles are thereby stably supported on support frames located behind the wall elements, so that no mechanical load is exerted on the glass wall elements.

In one embodiment of the present invention, there is also an indirect lighting source which is located behind the wall elements, to ensure that there is safe and adequate lighting.

As a result of the attractive, flat shape of the wall elements, these wall elements can be arranged in any desired order. The resulting arrangement can be either a straight line or any other desired configuration.

For example, individual wall elements can be used to create a urinal which has a shape which is bent in a circular arc or a polygon. These elements can be arranged in different patterns as a function of the space available, whereby the stationary stay pipes on the respective vertical sides of the individual elements are used to create a positive and non-positive connection between the individual elements. On account of the flexibility of the individually bent elements, it is possible to arrange them in a semi-circle, for example, or around a corner, or on a wall.

The individual elements or wall elements are preferably made of a glass which is structured on the reverse side. Glass is an elegant and non-porous surface which makes cleaning easier. The individual panes thereby are preferably made of safety glass (ESG—tempered safety glass), which has also been specially tempered. If the glass is provided with a screen printed pattern on the reverse side, the utility lines behind it are no longer visible. It is also possible to install indirect lighting behind the glass panel in certain areas. As a result of the use of glass as a construction material, these urinals can be cleaned easily. The individual elements thereby extend down to the floor. Inside the elements there are openings through which the corresponding flushing water lines or automated devices for the actuation of the flushing mechanisms can be routed.

When a plurality of individual elements or wall elements are used, these wall elements are fastened to the individual stay pipes, and the wall elements can be connected to one another in the visible area by means of panel profiles. The panel profiles are thereby also configured in the shape of a semi-circle to correspond to the wall elements, which results in an attractive overall aesthetic appearance. It is also possible to attach screen panels in the form of so-called modesty panels to the panel profiles.

The present invention can also be used to create a sanitary cubicle for various applications, which also has an aesthetically pleasing appearance and can be used in various construction applications. For example, it is also possible to realize the sanitary cubicle in the form of a kit, which can then be installed as part of a modular system.

The straight side walls and the rear wall are thereby bolted to one another by means of corner connecting brackets. To install the sanitary cubicle, which can be used as a toilet, a shower, or as a changing cubicle, it can be fastened to stay pipes by means of the side walls. In the facade there is a stationary semi-circular side part and a movable entrance panel in the form of a door.

Accessories of the type required in such a cubicle can also be attached to the side walls or installed in openings.

The individual cubicles can also be used by physically handicapped persons, because they make sufficient space available, and as a result of the aesthetically designed facade, they can be arranged in various patterns in the form of an almost complete semicircle, and there is sufficient space in the entrance area, because there is no swinging door to block the entrance. If a plurality of such sanitary cubicles are placed side by side, the next cubicle is attached by means of its side wall to the preceding stay pipe by the connection to the stationary stay pipes.

To automate the movable entrance facade, i.e. the movable panel, the modular cubicle is provided with an electric motor drive system and a control and regulation system for the movable panel. The movable panel is mounted so that it can be displaced on a runner rail which is in a door case above the panel. Neither the stationary side piece nor the movable panel have to be straight, but can also be bent in the shape of a circular arc. If the movable panel is moved, it is parked behind the stationary side piece. For automatic operation, the electro-mechanical drive system is also installed in the door case. The drive system includes an electronic control and regulation system (open-loop/closed loop control system), which also contains the safety devices for the operation of such a motor-driven movable panel. That means that the force which can be applied by the primary and secondary closing edge is limited, which means that there is no danger to the persons using the movable panel if they come in contact with such a moving panel.

So that the movable panel can be placed in its open position, it is possible that the door can be opened by means of a sensor signal, e.g. in the form of a switch on the outside of the sanitary cubicle. When the person has entered the sanitary cubicle, the door closes automatically. Only when an additional switch is actuated inside the sanitary cubicle does the door open again. Once a person has entered the sanitary cubicle, a corresponding interlock prevents anyone else from entering the cubicle from outside. Such a sanitary cubicle can be in particular equipped for use as a toilet, a shower or a changing cubicle. The entire cubicle can thereby be preferably made of elements which are made of glass. Glass can also be used for the stationary side piece and the movable panel. The glass can thereby be structured on one side, e.g. with an appropriate screen-printed pattern, thereby providing an opaque screen.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in further detail below with reference to several embodiments which are schematically illustrated in the accompanying drawings:

FIG. 8 shows a panel profile in cross section;

FIG. 9 shows a detail of a terminal area with an enlarged cross section of the panel profile;

DESCRIPTION OF THE PREFERRED EMBODIMENT

Figure 1:
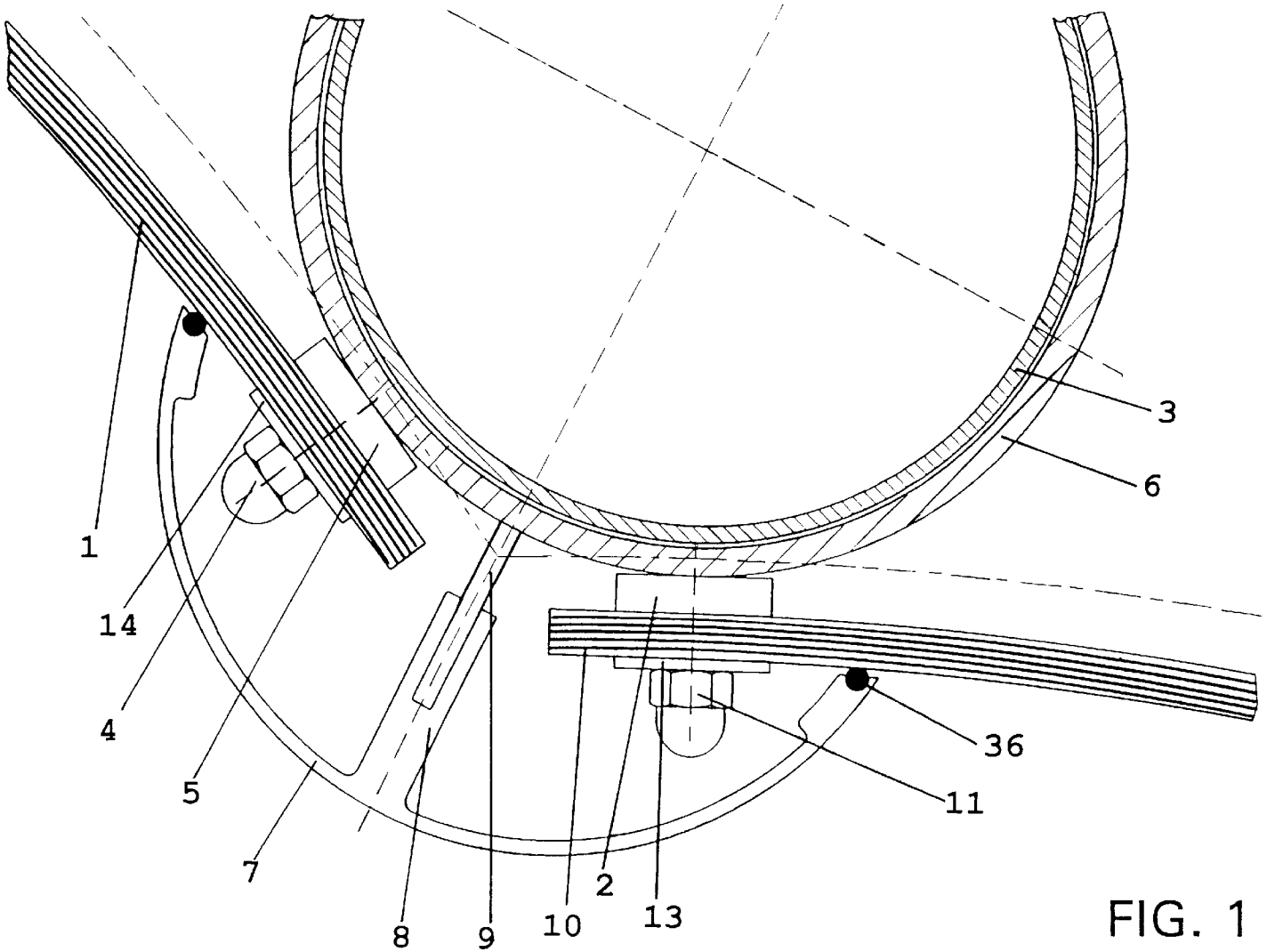
FIG. 1 is a detail of two curved wall elements above an installation clamp on a tube with a panel profile.

The detail illustration in FIG. 1 shows a stay pipe 3 which is preferably surrounded by an installation clamp 6. The stay pipe 3 and the installation clamp 6 are not shown in their entirety in the figure. In this embodiment, the tube or stay pipe 3 in question is preferably round. On the installation clamp 6, fastening locators 2, 5 can be positively and non-positively connected to the installation clamp 6. The fastening locators 2, 5 may thereby have, toward the outside, i.e. pointing away from the installation clamp 6, threaded studs which are used for the subsequent fastening of wall elements 1, 10. At the same time, in the lower area, i.e. beginning at the base of the fastening locator 2 or 5, there can be an extension which projects into the wall element 1 or 10 to be placed on the extension. For that purpose, there is preferably a boring in the wall elements 1, 10. The wall elements 1, 10 are preferably made of glass; the wall elements 1, 10 need not necessarily be flat, but may be curved. After the wall elements 1, 10 are put in place, the wall elements 1, 10 must preferably be positively and non-positively connected to the installation clamp 6. This connection may be accomplished by first placing washers 13, 14 on the projecting threaded studs of the fastening locators 2, 5. After the wall elements 1, 10 have been put in place, fastening elements or fasteners 4, 11 in the form of nuts can then be screwed on the projecting threaded studs of the fastening locators 2, 5. By tightening the fasteners 4, 11 in connection with the fastening locators 2, 5 it may be possible to fix the wall elements 1, 10 positively and non-positively in place. The installation clamp 6 can then be positively and non-positively connected to the stay pipe 3. This connection can also be accomplished by means of a screw connection.

On the installation clamp 6 there can also be a positive and non-positive connecting element 9 which connecting element 9 can be used to fasten a panel profile 7 to be placed invisibly in the joint area of the wall elements 1, 10.

In other words, the panel profile 7 can be attached to the installation clamp 6 by means of the connecting element 9. The panel profile 7 itself can block from view both its connection with the connecting element 9, as well as the fastening of the wall elements 1, 10 to the installation clamp 6. The connection of the panel profile 7 to the installation clamp 6 allows the panel profile 7 to block from view, or make invisible, the joint area of the wall elements 1, 10, resulting in a more aesthetically pleasing joint.

FIG. 8 shows this panel profile 7, which is shown in cross section with two legs 31, 33 of equal length. This illustrated panel profile 7 can have a cross section in the shape of a circular arc and is preferably symmetrical with respect to a retaining leg 8 which is on an inside 30, i.e. on the concave side of the panel profile 7. In the terminal areas of each of the legs 31, 33, there can be enlarged cross sections 34, 35. Inside the enlarged cross sections 34, 35, as shown in FIG. 9, there may be depressions 28 which extend over the entire length of the panel profile 7. Inside these depressions 28, an elastic gasket or seal 36 can be inserted, as shown in FIG. 8, so that when the panel profile 7 is put in place on the substructure of the stay pipe 3, there is a tight and clean seal with respect to the wall elements 10, 38 (see FIG. 7), for example.

To connect the panel profile 7 invisibly with the stay pipe 3, there can be a recess 29 in the retaining leg 8. This recess 29 can be designed, for example, so that at this point there are undercuts which interact with locking lugs on the stay pipe 3 so that when the locking lugs are inserted, there is a positive and non-positive connection with the panel profile 7. It is also possible, however, to create a fastening by means of threaded rods or screw elements. The type of fastening to be used can be defined as a function of the location and conditions of installation. It is also conceivable that the panel profile 7, as shown in FIG. 8, can be realized in the form of a quarter-circle, to cover a corner area.

In another possible embodiment of the present invention, the recess 29 of the retaining leg 8 can be designed to have undercuts which interact with locking lugs on the connecting element 9, which is attached to the stay pipe 3, so that a positive and non-positive connection is formed between the panel profile 7 and the installation clamp 6 when the locking lugs are inserted in the undercuts. The connection of the retaining leg 8 and the connecting element 9 may also be by means of threaded rods or screw elements. The type of connection can be dependent on the location and conditions of installation.

Figure 6:
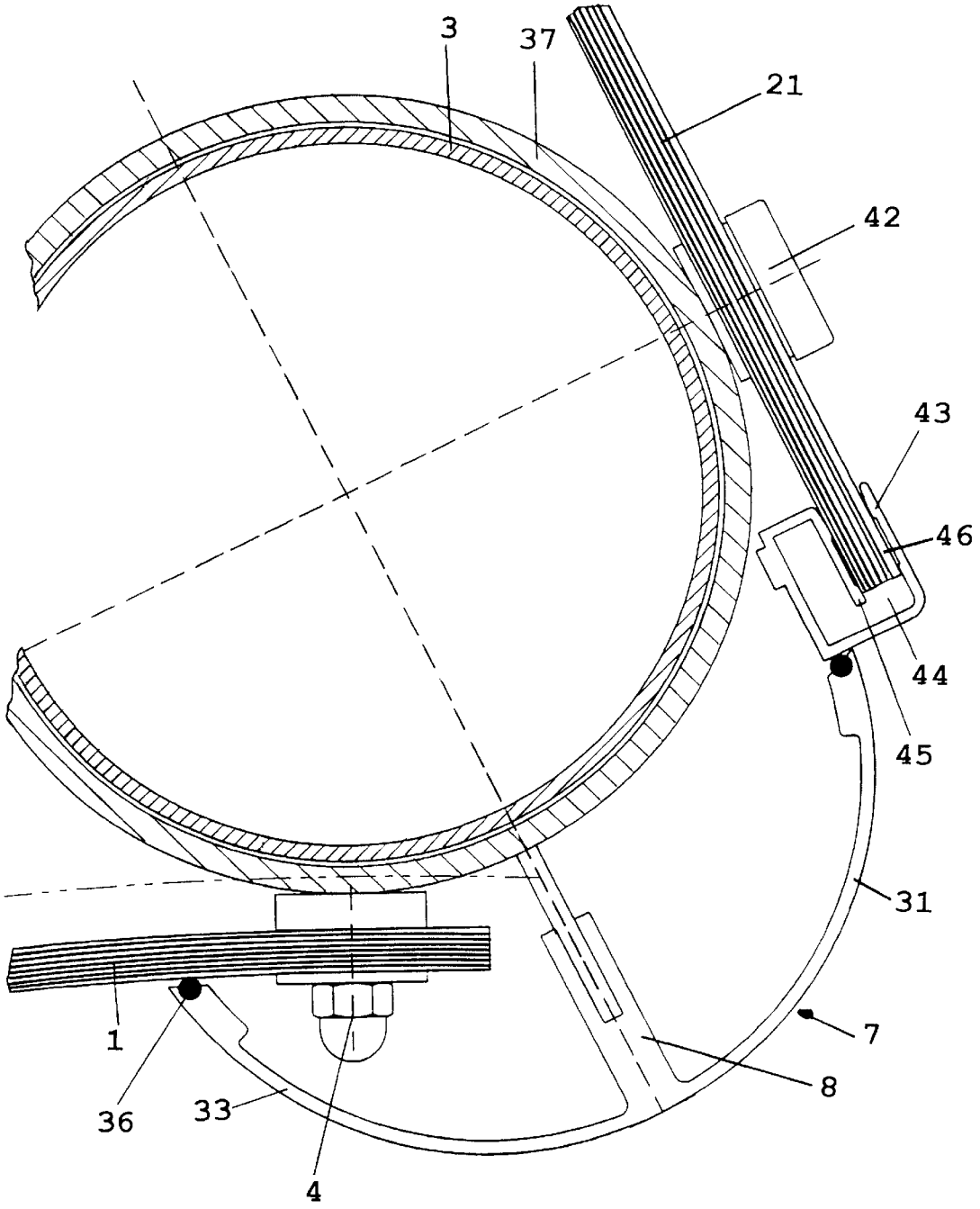
FIG. 6 shows the paneling of a curved wall element with a straight wall element.
Figure 7:
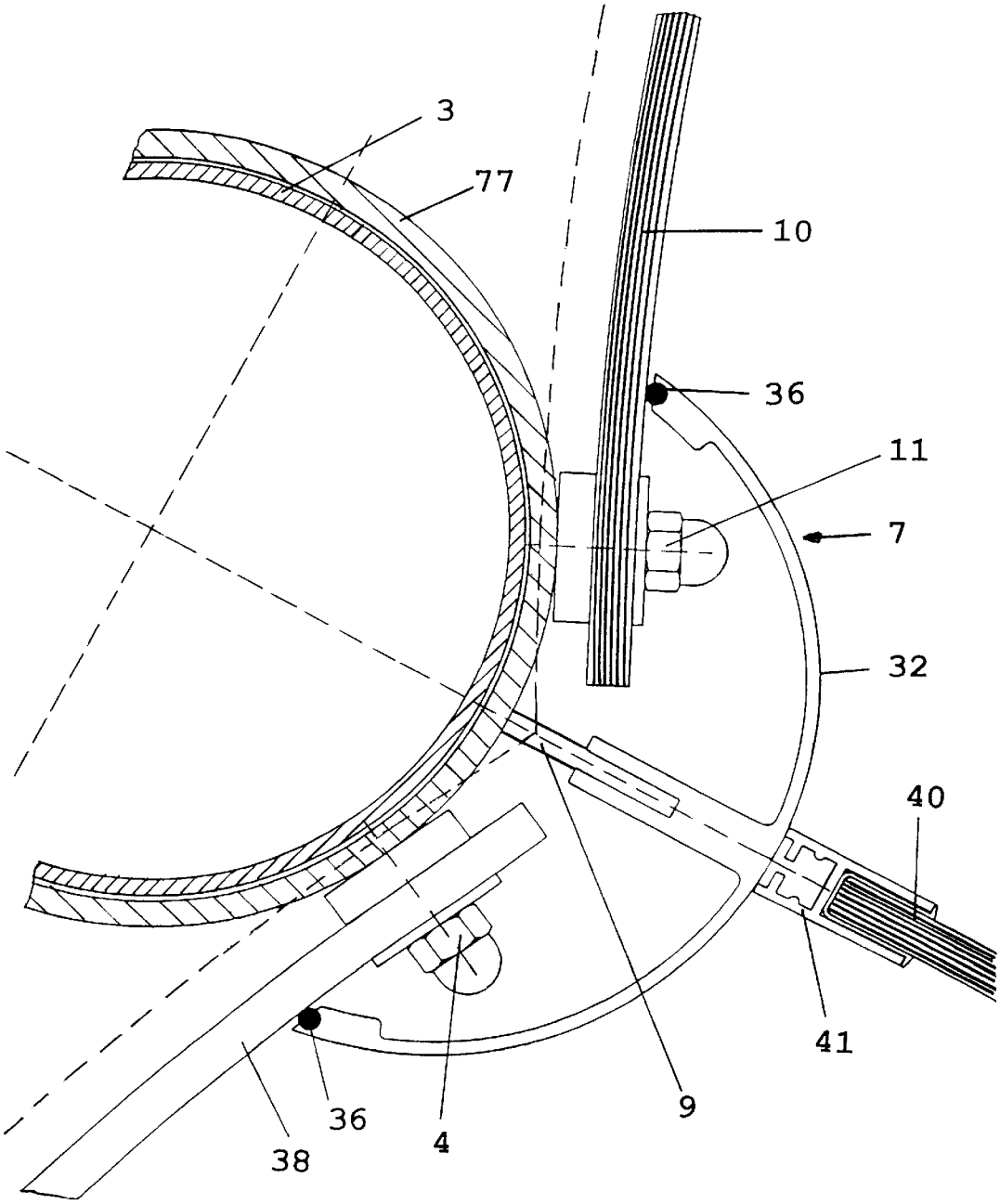
FIG. 7 shows an installed panel profile with an additional profile attached to it.

FIG. 7 shows an additional panel profile 77, fastened in place, which can be connected to a stay pipe 3. A fastening clamp 37 (see FIG. 6) can thereby be installed around the stay pipe 3, to which fastening clamp 37 can be attached to both the wall elements 10, 38 used in the embodiment. The wall elements 10, 38 can be glass panels, and are installed by means of connecting elements 4, 11 to the panel profile 77. The wall elements 10, 38 can thereby be connected positively and non-positively to the fastening clamp 37 by means of the fasteners 4, 11.

As also illustrated in this embodiment, on the outside 32 of the panel profile 7, i.e. on the convex side, there is preferably an additional profile 41. This profile 41 can be used, for example, to connect additional elements at this point, e.g. in the form of a glass panel 40.

In another possible embodiment of the present invention, the fastening clamp 37 can be installed around the stay pipe 3. The wall elements 10, 38 may be connected positively and non-positively to the fastening clamp 37 by means of fasteners 4, 11. The panel profile 7 is preferably connected to the fastening clamp 37 by means of a connecting element 9.

In the area where the panel profile 7 comes into contact with the wall elements 10, 38, the seals 36 are preferably compressed, and thereby ensure that there is a clean and functional closure of the intermediate spaces which are formed between the panel profile 7 and the wall elements 10, 38.

The panel profile 7 can also be used, as shown in FIG. 6, to span different wall elements 1, 21. In the embodiment illustrated in FIG. 6, once again on a stay pipe 3 there may be a fastening clamp 37, on which on one hand a wall element or curved glass panel 1 is attached by means of the fastener 4, and on the other hand a straight wall element 21, oriented at an acute angle in relation to the first element or wall element 1, in the form of another glass panel. The wall element 21 can thereby be positively and non-positively connected by means of a fastener 42 with the fastening clamp 37. In a terminal area 46 of the wall element 21, an edge profile 43 can be pushed onto this wall element 21. The terminal area 46 between an outer leg of the edge profile 43 and a leg 45 which lies inside the edge profile 43 can thereby be inserted into a clamping area 44. The panel profile 7 can be also used for such an application in which the arrangement is not symmetrical. The panel profile 7 can thereby be fastened to the fastening clamp 37 by means of the retaining leg 8. The leg 33 of the panel profile 7 can thus be in contact by means of its terminal area and the seal 36 located in the terminal area with the glass panel 1. Simultaneously, however, the leg 31 of the panel profile 7 is preferably in contact with the edge profile 43 of the wall element 21. This embodiment illustrates the fact that the panel profile 7 can be used universally, and thus offers the capability of covering construction elements cleanly and invisibly, whereby a rapid disassembly is still possible.

In another possible embodiment of the present invention, the panel profile 7 can be used to conceal joints formed by wall elements 1, 21 disposed at different angles with respect to each other. In the terminal area 46 of wall element 21 an edge profile 43 can be pushed onto the wall element 21. The terminal area 46 of wall element 21 can be inserted into a clamping area 44, of the edge profile 43, between the outer leg of the edge profile 43 and the leg 45 of the edge profile 43. The leg 33 of the panel profile 7 can have a seal 36 in its enlarged cross-section 35 and the seal 36 comes into contact with the wall element 1.

Figure 2:
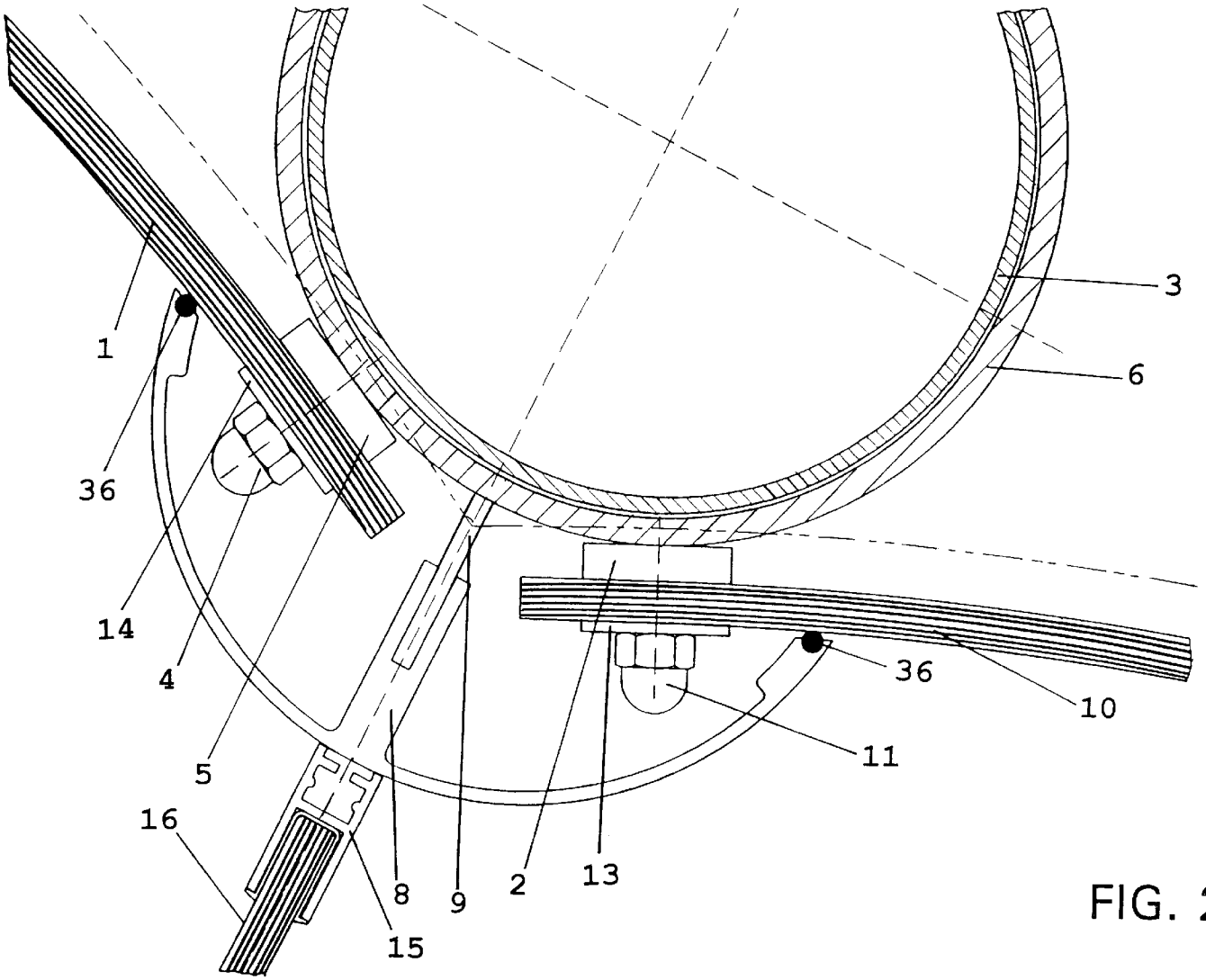
FIG. 2 is a detail of two curved wall elements above an installation clamp on a tube with a panel profile, plus an additional connecting profile for the connection of an additional glass element.

In the embodiment illustrated in FIG. 2, the basic structure is the same as in the embodiment illustrated in FIG. 1, but in this case, on the panel profile 7, an additional profile 15 has been attached in the convex outer region or outside 32 of the panel profile 7. This additional profile 15 can be used to connect an additional glass panel 16 which projects out into the room. The use of such additional glass panels 16 makes it possible to provide modesty panels, for example, in sanitary areas, in particular for urinals.

Figure 3:
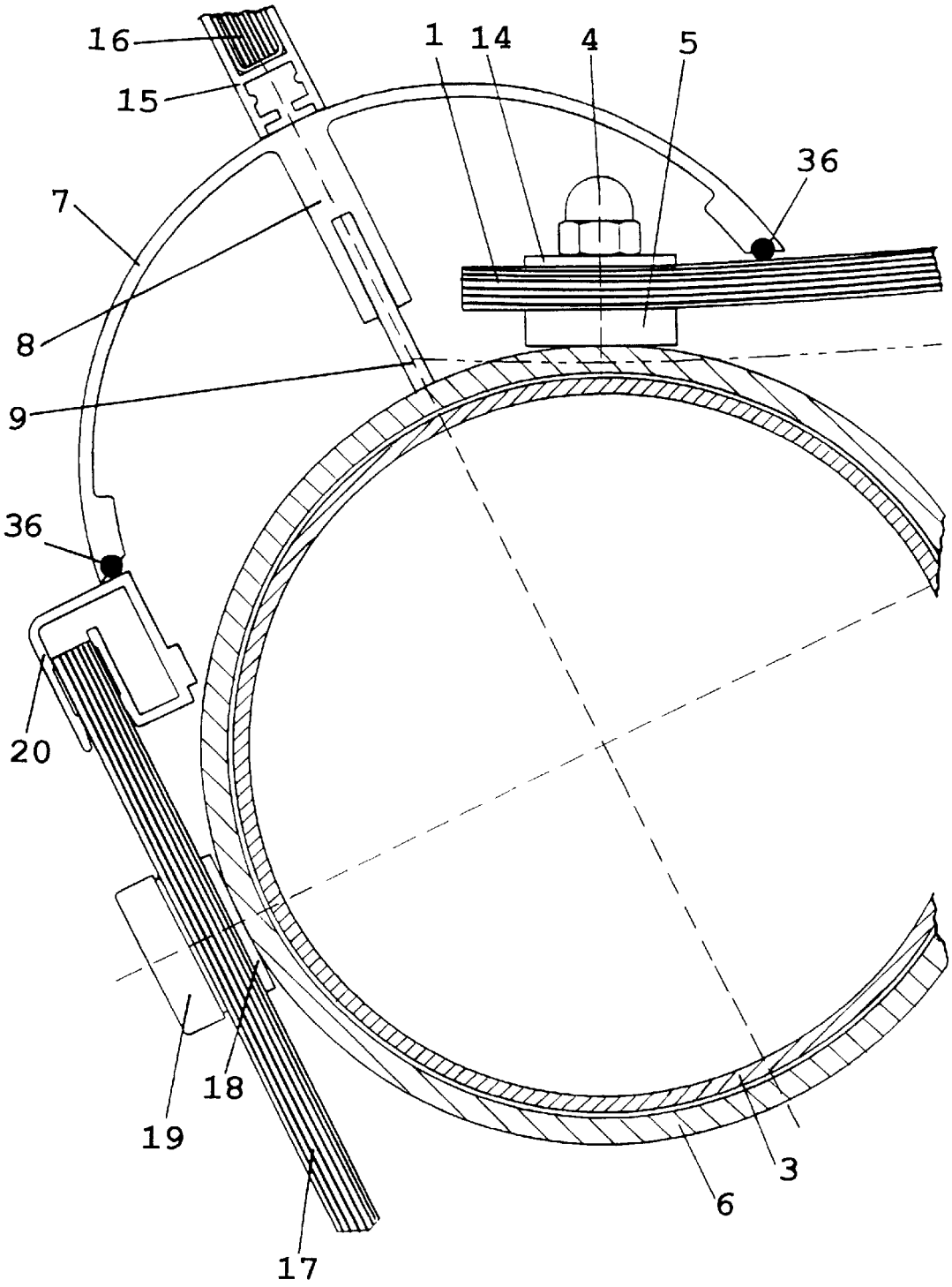
FIG. 3 is a detail of a corner connecting bracket between a straight and a curved wall element, with an installation clamp on a tubular element.

The present invention also claims a solution for the placement of a wall element 17, which is not symmetrical to a stay pipe 3, as illustrated in FIG. 3. In this case, too, an installation clamp 6 has been used, to which the fastening locator 5 is preferably positively and non-positively connected, to hold the wall element 1 in position. The wall element 1 can then be in turn connected by means of the fastening element 4 to the fastening locators 5 located underneath. At the same time, however, as can be the case in outdoor areas, a straight glass panel 17 may be connected. This connection can also be made by means of a fastening locator 18 which is positively and non-positively attached to the installation clamp 6. In the straight glass panel 17 there is preferably a boring which makes it possible to attach the fastening locator 18 on a projecting extension. Then, a fastener 19 can be connected from outside positively and non-positively to the fastening locator 18. This fastener 19 can be realized in the form of a round element.

In another possible embodiment of the present invention, the straight glass panel 17 can have a boring through which a projecting extension of the fastening locator 18 can extend to receive a fastener 19. The fastener 19 and the fastening locator 18 can be used to hold the straight glass panel 17.

In the terminal area of the straight glass panel 17, an edge profile 20 can be installed. This edge profile 20 makes it possible to achieve a clean closing of the glass edge of the straight glass panel 17. At the same time, one leg of the edge profile 20 can also be used to function as a stop or contact for a panel profile 7 with its one leg 31 (see FIG. 8) and the seal 36 located in said leg 31. The other leg 33 of the panel profile 7 can thereby be in contact with the curved glass panel or wall element 1 and simultaneously covers the fastening area with the fastening element 4. The panel profile 7 can be in turn also fastened by means of a connecting element 9 which is fastened to the installation clamp 6 and interacts with the retaining leg 8 of the panel profile 7. In this embodiment, moreover, in the outer area or outside 32 (see FIG. 8) of the panel profile 7, a profile 15 can be attached in which, as described above, a glass panel 16 can be inserted.

Figure 4:
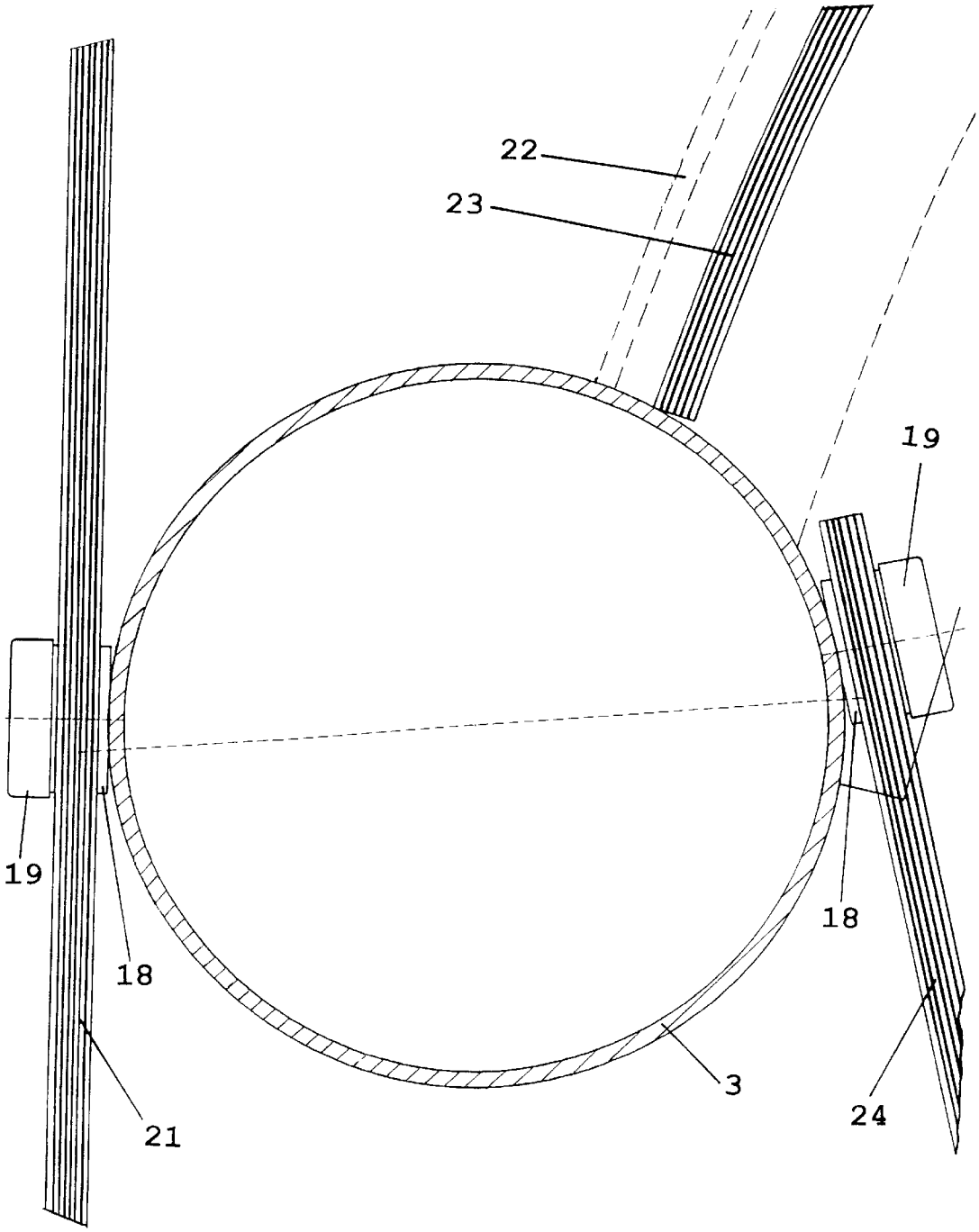
FIG. 4 is a detail of a connection between two straight, stationary wall elements and a curved side pieces with a door case (without an installation clamp)
Figure 5:
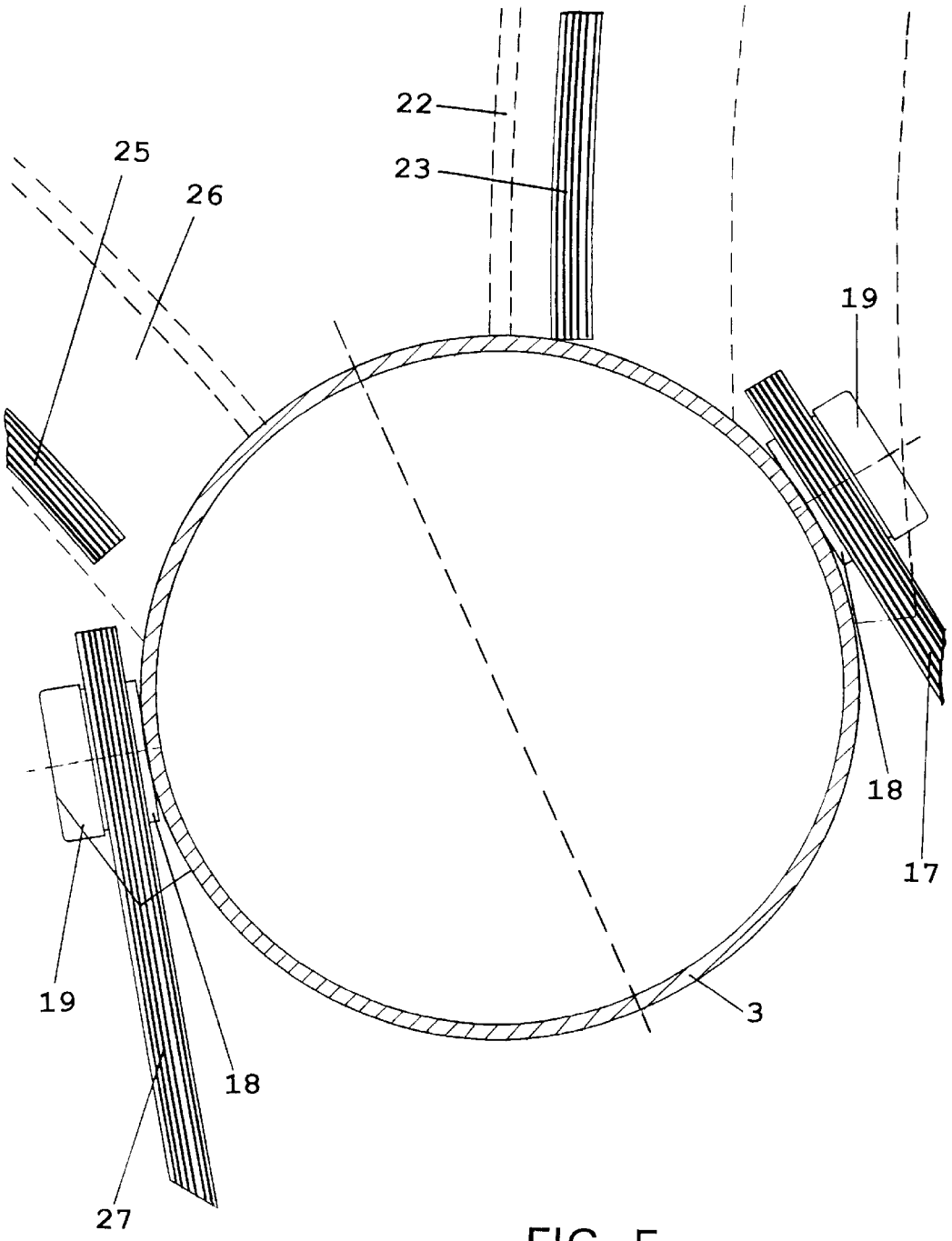
FIG. 5 shows a connection of two straight wall elements and two door cases with a stationary side piece and a movable panel (without an installation clamp)

The embodiments illustrated in FIGS. 4 and 5 illustrate how broad the range of applications of the teaching of the present invention actually is. There is no installation clamp in these embodiments, and in addition, the connection of a door case 22 for the installation of a fixed or stationary side piece 23 and a movable panel 25 (see FIG. 5) is shown in FIG. 4.

The fastening locators 18 in this case may be directly connected, positively and non-positively, to the stay pipe 3. Each of wall elements 21, 24 is attached to these fastening locators 18, and is preferably positively and non-positively held in position by means of the fasteners 19 in connection with the fastening locators 18. FIG. 4 also illustrates a door case 22 which can be adjacent to the outer wall of the stay pipe 3. Inside the door case 22 there may be a stationary side piece 23. The stationary side piece 23 can also be in contact by means of one outside edge with the outer wall of the stay pipe 3.

The embodiment illustrated in FIG. 5, in addition to the fastening of two wall elements 17, 27 by means of the fastening locators 18, in connection with the fasteners 19, shows the connection of two door cases 22, 26. Also shown on the door case 22 is a stationary side piece 23, as described above in relation to FIG. 4. In this detail drawing, inside the door case 26 there can be a movable panel 25 which, when closed, is in contact by means of its outside edges, with the outer wall of the stay pipe 3. This movable panel 25 can be displaced laterally, and for this displacement is connected to carriers on a runner rail (not shown) which is located inside the door case 26. The movable panel 25 can be put in motion either manually or automatically by means of a corresponding drive mechanism (not shown). The movable panel 25 and the stationary side piece 23 can be realized both in the form of straight wall elements and also in the form of curved wall elements.

As a result of the object claimed by the invention, namely the connection and attachment of plate-shaped wall elements 1, 10, 17, 21, 24, 27, 38 made of glass to stationary tubular elements or stay pipes 3, 61, whereby the tubular elements 3, 61 can assume a round shape or any other shape, it becomes clear that a clean, appropriate and secure type of fastening has been created. In particular for use in sanitary areas, whether the room in question is used as a shower, toilet or changing room, this type of connection can be realized safely and economically. The wall elements 1, 10, 21, 24, 27, 38 are preferably made of glass, but they can also be made of any other suitable material.

Figure 10:
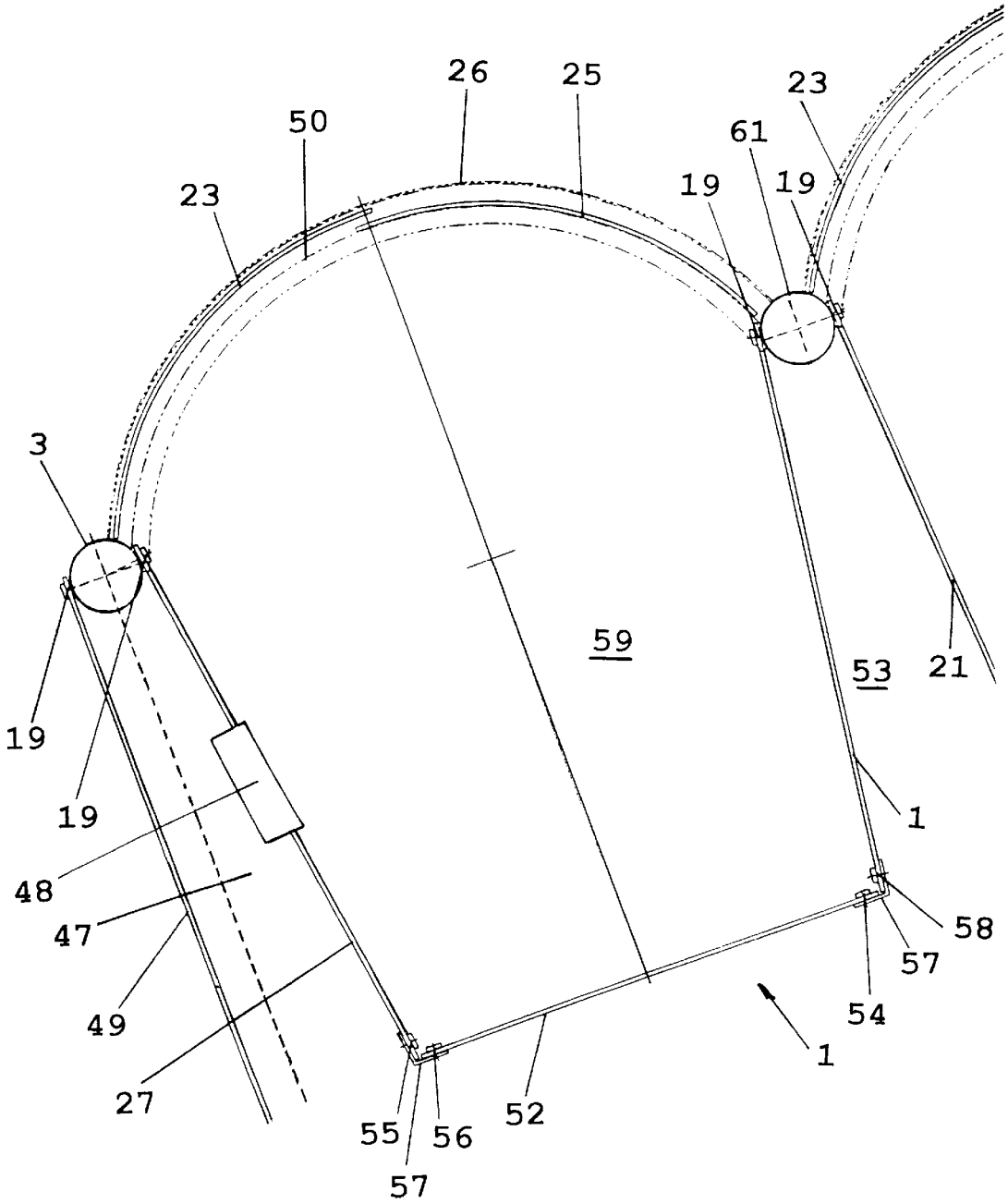
FIG. 10 shows a kit for a modular sanitary cubicle.
Figure 10A:
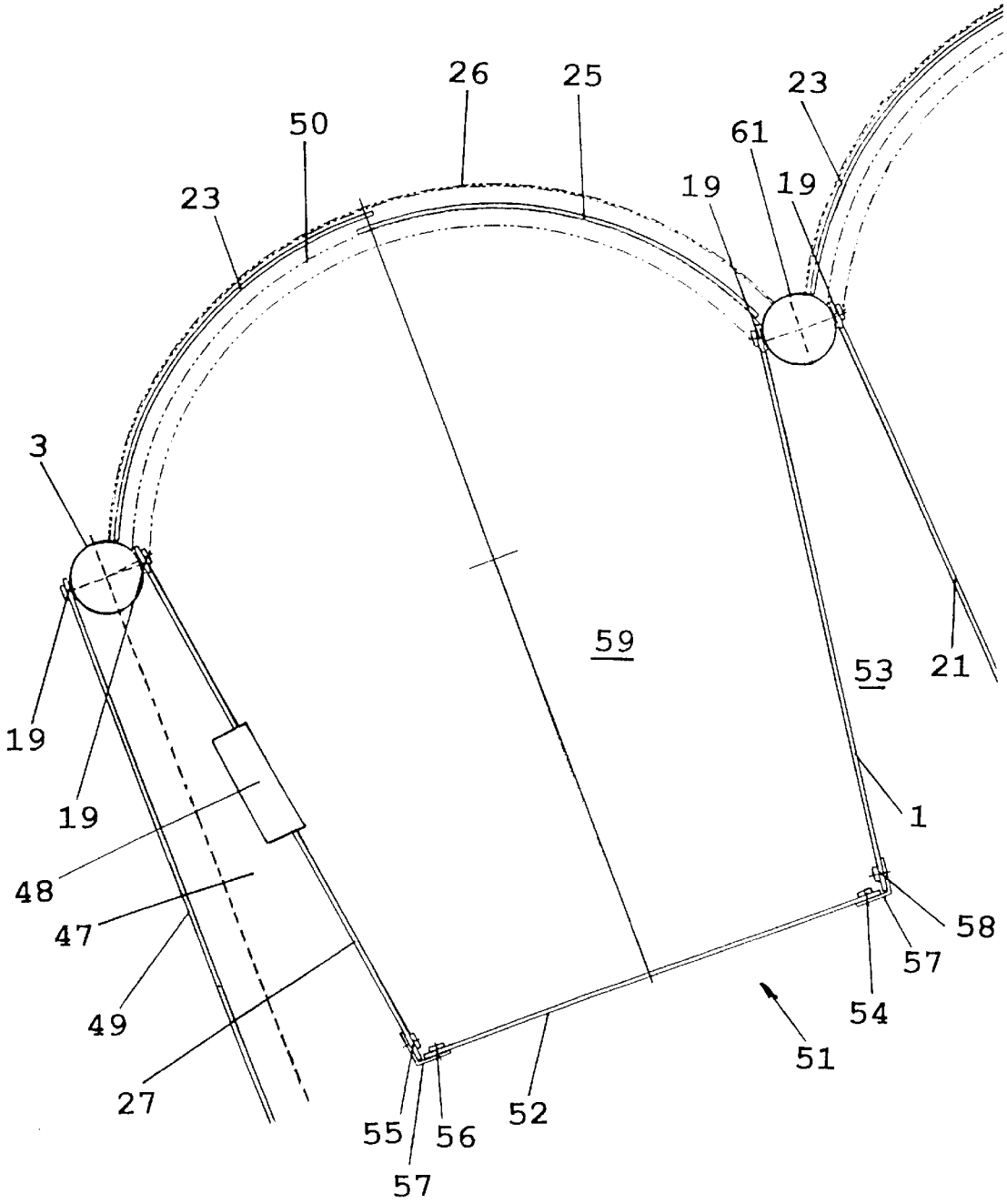
FIG. 10A shows additional features of the kit for a modular sanitary cubicle of FIG. 10.

FIG. 10, for example, illustrates a sanitary cubicle 51 (see FIG. 10A) which may consist of the elements described above and an enclosed interior space 59 which is defined by the side walls 1, 27 and by the rear wall 52 in the rear area.

The side walls 1, 27 and the rear wall 52 can thereby be connected positively and non-positively to one another by means of corner connecting brackets 57 and fasteners 54, 55, 56, 58. A corner connecting bracket 57 can thereby be realized in the form of a right angle, or in an obtuse angle, as shown in the illustrated embodiment. The resulting space may thereby be in the shape of a trapezoid which is formed by the side wall 1, 27 and the rear wall 52.

In the forward area of the side walls 1, 27, there can be stay pipes 3, 61 located laterally on each side. On the stay pipes 3, 61, the trapezoid-shaped rear portion of the sanitary cubicle 51 is preferably positively and non-positively connected to the stationary stay pipes 3, 61 by means of a fastener 19.

The facade can be closed by an entryway which is approximately in the shape of a semicircle. A stationary side piece 23, in the form of a curved panel, is preferably located on one half of the semicircle. The other half of the semicircle may be closed by a movable entry panel 25. The movable entry panel 25 can thereby be located on a door case 26 which is also fastened in the upper area between the stay pipes 3, 61 so that it can move by means of a runner rail 50. If the movable entry or entrance panel 25 is moved out of its closed position, which can be done either manually or by the force of a motor, it is pushed behind the stationary side piece 23, since both the side piece 23 and the entrance panel 25 have the same curved shape. As a result of this measure, there is no door which projects outward into the room.

Paper dispensers 48 or other accessories can be installed in the side walls 1, 27. The individual sanitary cubicles 51 can also be arranged in a row, whereby each additional sanitary cubicle 51 is attached to an existing stay pipe 3, 61 of the preceding sanitary cubicle 51, as shown in the embodiment illustrated in FIG. 10 on the stay pipe 61. One side wall 21 can thereby be connected positively and non-positively to the stay pipe 61 by means of a fastener 19. Between the two sanitary cubicles 51 with their side walls 1, 21, an intermediate space 53 may be formed, which can be used for the installation of the corresponding utility lines outside the individual cubicles for water and electricity.

In the terminal area, i.e. where no additional cubicle is connected, a screen wall 49 can preferably be installed, which is then connected positively and non-positively to the stay pipe 3 by means of a fastener 19. In this case, too, an intermediate space 47 is formed which can also be used for installation of the corresponding utility lines. To facilitate the cleaning of such sanitary cubicles 51, the entrance panel 25 is preferably guided only by means of the runner rail 50, i.e. there are no guide elements in the vicinity of the floor.

An entrance panel 25 of the type described above can also be displaced automatically. If there is an automatic drive mechanism, in addition to an open-loop/closed-loop control unit, the entire drive unit with the safety elements is located inside the door case 26. Therefore there are no components visible to the user from the outside.

The entrance panel 25 is preferably not guided by means of a guide rail installed in the vicinity of the floor. The entrance panel 25 can be actuated by means of a sensor signal which can be emitted manually. When the entrance panel 25 is closed, the interior 59 of the sanitary cubicle 51 can be closed, which makes it suitable for a variety of purposes, such as a shower, toilet or changing room.

Figure 11:
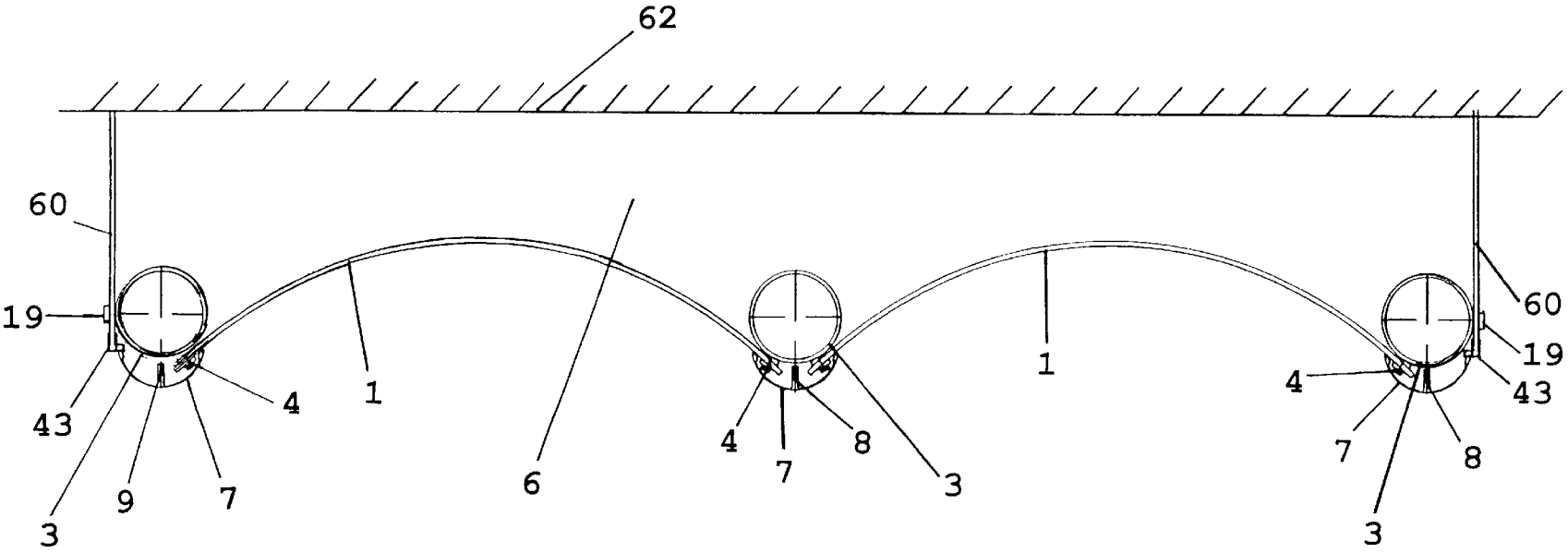
FIG. 11 shows one realization of a sanitary installation wall.
Figure 11A:
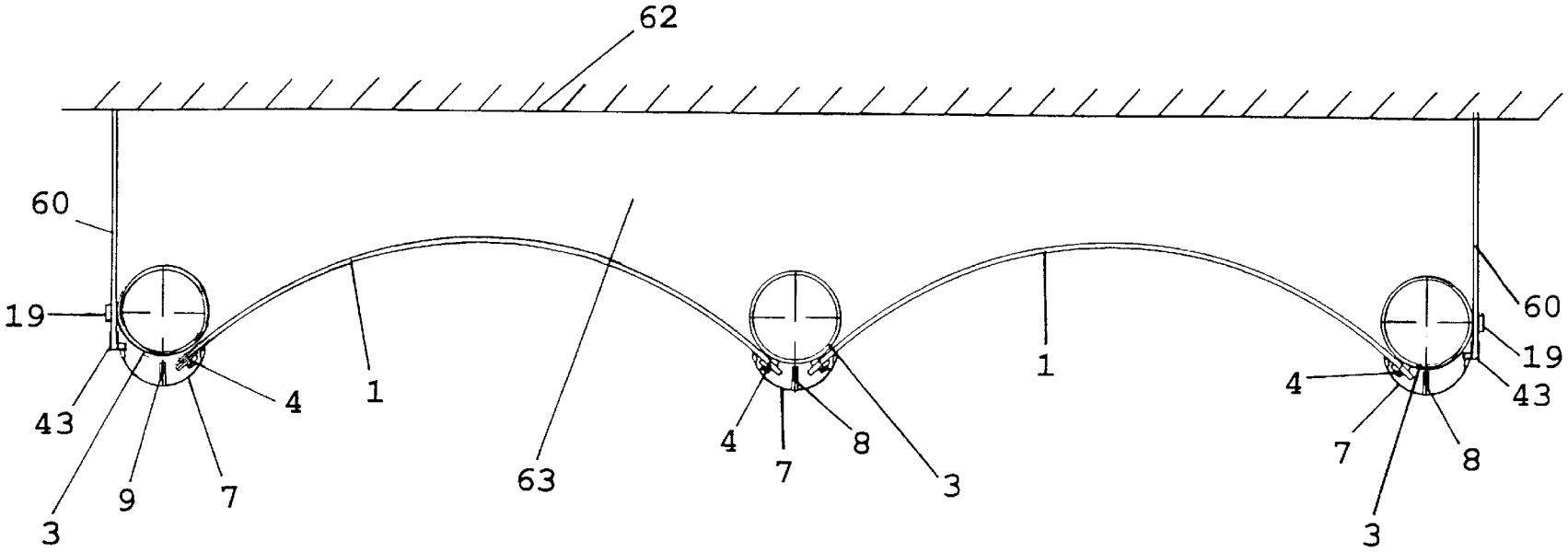
FIG. 11A shows additional features of the sanitary installation wall of FIG. 11.

As shown in FIG. 11, the wall elements 1 can also be constructed to be within a straight line relative to one another. There is no limit to the number of wall elements 1 which can be installed in a row. The wall elements 1 can thereby be securely fixed in place by means of fasteners 4 with stay pipes 3 which are positively and non-positively connected to the floor. The stay pipes 3 can thereby be at the appropriate distance from the building wall 62, to ensure that the corresponding utility lines and fastening fixtures can be installed in the space 63 (see FIG. 11A) behind the stay pipe 3. To securely enclose this space 63 on the sides, there are side elements 60 which are also connected positively and non-positively by means of fasteners 19 to the outer stay pipes 3. In the terminal area of the side elements 60, in the vicinity of the stay pipes 3, an edge profile 43 is preferably installed on the longitudinal edge of the side elements 60. This edge profile 43 makes it possible, in connection with a panel profile 7, to make both the stay pipe 3 and the fastener 9 of the wall element 1 invisible.

Figure 12:
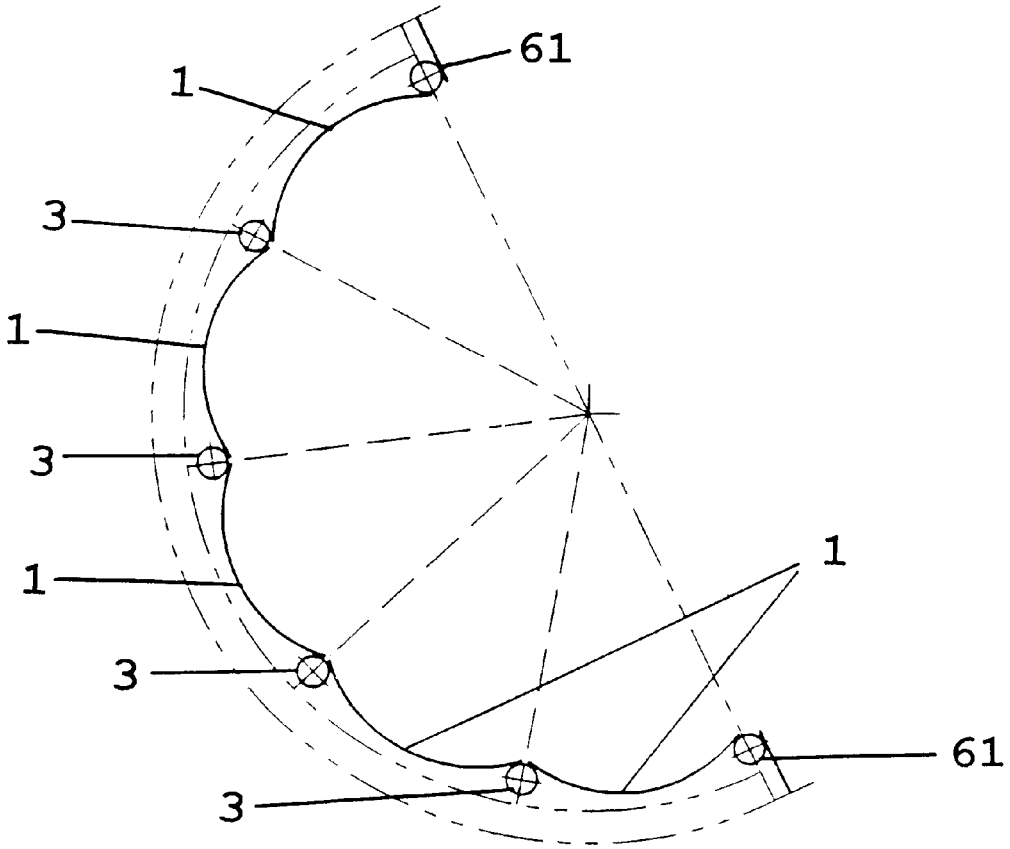
FIG. 12 shows a semicircular arrangement of elements connected to one another to form a urinal.
Figure 13:
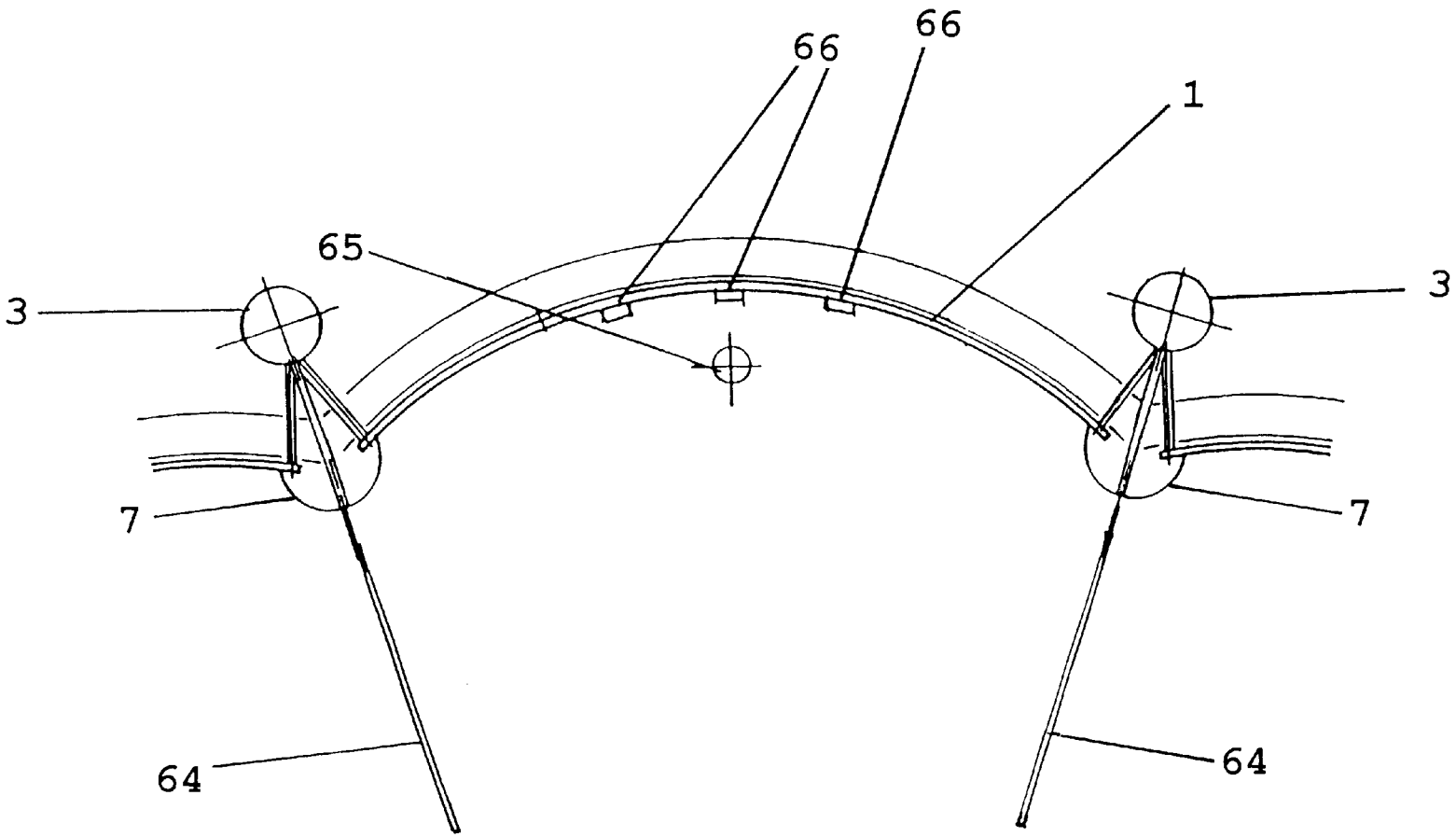
FIG. 13 is a detail of the realization illustrated in FIG. 12.

The embodiments illustrated in FIGS. 12 and 13 are not intended to be limiting, and the elements can also be in any shape other than a semicircle. To create a urinal with a plurality of individual stalls, individual elements or wall elements 1 can be fastened between stay pipes 3. At the same time, modesty panels 64 (see FIG. 13) which project into the room can be fastened to the panel profiles 7.

Inside the wall element 1 there are borings, through which a flushing water line 66 may be attached from the reverse side of the wall element 1 for distribution on the front side of the wall surface. In the collecting basin for the water and urine located underneath it, there can be a floor drain 65. It is also conceivable that the system can be used with a dry urinal, i.e. one which does not have a flushing device.

Figure 14:
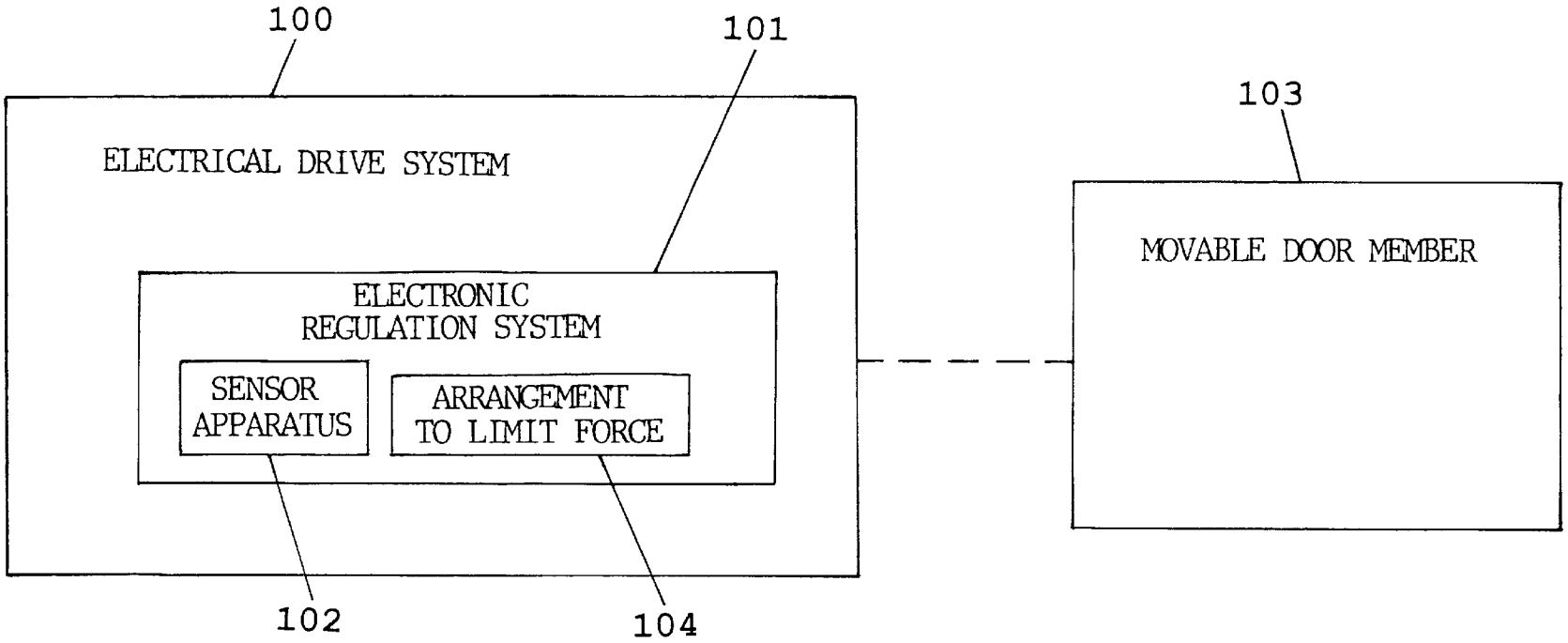
FIG. 14 is a block diagram depicting one possible embodiment of the present invention.

FIG. 14 shows by way of a block diagram, one possible embodiment of the present invention wherein a movable door member 103 can be operatively connected to an electrical drive system 100, with the electrical drive system 100 being configured to move the movable door member 103 between a first opened position, and a second closed postion. This electrical drive system 100 can have an electronic regulation system 101 to control operation of the electrical drive system 100. This electronic regulation system 101 can have a sensor apparatus 102 which can be configured to send a signal to the electrical drive system 100 to move the door member 103 into the first or opened position in response to a user being outside of the cubicle. The electronic regulation system 101 can be configured to move the door member 103 into the second or closed position in response to a user entering the cubicle. This sensor apparatus 102 can be configured to be inactive in response to a user occupying the cubicle. Further, this electronic regulation system 101 can comprise an arrangement 104 to limit the force the electrical drive system 100 applies to the door member 103 in moving the door member 103 between the first position and the second position.

The embodiments illustrated above are not intended to be limiting to sanitary cubicles. For example, it is conceivable that the present invention could be applied to modular office space construction, wherein the stay pipes could carry data or electrical connections. Of course, other uses for the spaces defined by the use of the present invention could be found.

One feature of the invention resides broadly in the interior construction system for a sanitary area, which may consist of in particular the following construction elements: plate-shaped wall elements 1, 10, 17, 21, 24, 27, 38 made of glass, which are either straight or are curved into a radius; load-bearing supports in the form of stay pipes 3, whereby on the stay pipes 3 there are fastening locators 18, on which the wall elements 1, 10, 17, 21, 24, 27, 38 which have borings located in this area are located, and connecting elements 19 are used to make positive and non-positive connections; a panel profile 7 which has a cross section which follows a circular arc, whereby the two legs 31, 33 of the panel profile 7, which proceed from a retaining leg 8, each have, on the inside of their terminal areas, an enlarged cross section 34, 35, whereby in the enlarged cross sections 34, 35 there is a recess 28 for the location of a seal 36, and that on the inside of the panel profile 7 there is at least one retaining leg 8 which has a recess 29 for the location of a fastening means, and the retaining leg 8 in turn has fastening means which can be installed on a substructure to create an externally invisible, positive and non-positive connection with said substructure.

Another feature of the invention resides broadly in the interior construction system characterized by the fact that on the stay pipes 3 there is preferably an installation clamp 6 which has fastening locators 2, 5 on which the wall elements 1, 10, 17, 21, 24, 27, 38 are placed by means of borings located in this vicinity in the wall elements, and connecting elements 4, 11 are used to create a positive and non-positive connection.

Yet another feature of the invention resides broadly in the interior construction system characterized by the fact that the terminal areas of the wall elements 1, 10, 17, 21, 24, 27, 38 with the fastening elements 4, 11 can be covered by panel profiles 7.

Still another feature of the invention resides broadly in the interior construction system characterized by the fact that the wall elements 1, 10, 17, 21, 24, 27, 38 may be made of structured glass and also have a screen printed pattern on one side.

A further feature of the invention resides broadly in the interior construction system characterized by the fact that the interior construction system is in the form of a kit which can be used to install a modular sanitary cubicle 51 and may consist essentially of: a rear wall 52; two side walls 1, 27; one stationary side piece 23; one movable door panel 25; the rear wall 52 is connected to the side walls 1, 27 by means of corner connection brackets 57 and the fasteners 54, 55, 56, 58 and the side walls 1, 27 are connected in the entry area by means of fasteners 19 to stationary stay pipes 3, 61; and that connected to the stay pipes 3, 61 there are door cases 22, 26, whereby fastened in the door case 22, 26 is a stationary side piece 23, and also in the door case 22, 26 is a runner rail 50 on which the door panel 25 can be moved.

Another feature of the invention resides broadly in the interior construction system characterized by the fact that the movable panel 25 can be moved by means of an electrical drive mechanism in connection with an electronic control and regulation system into the open position in response to a sensor signal given by a person on the outside, and when the person enters the sanitary cubicle 51, the moving panel 25 moves automatically into its closed position.

Yet another feature of the invention resides broadly in the interior construction system characterized by the fact that when a person is in the sanitary cubicle 51, the sensor signal which can be actuated from outside is inactive.

Still another feature of the invention resides broadly in the interior construction system characterized by the fact that in the control and regulation system there may be means which limit the forces which occur on the primary and secondary closing edges.

A further feature of the invention resides broadly in the interior construction system characterized by the fact that behind the rear sides of the sanitary cubicles 51 or the wall elements 1, 10, 17, 21, 24, 27, 38, there can be utility lines and components for lighting fixtures, and the utility lines and components are run into the sanitary cubicle 51 through borings in the wall elements 1, 10, 17, 21, 24, 27, 38.

Another feature of the invention resides broadly in the interior construction system characterized by the fact that in the wall elements 1, 10, 17, 21, 24, 27, 38 there are preferably openings or borings through which sinks and/or consoles, soap dispensers and at least one faucet can be connected to the utility lines behind the wall elements.

Yet another feature of the invention resides broadly in the interior construction system characterized by the fact that on the rear side of the wall elements 1, 10, 17, 21, 24, 27, 38 there is preferably an indirect source of illumination.

Still another feature of the invention resides broadly in the interior construction system characterized by the fact that the sanitary cubicle 51 can be used as a shower stall, changing room, toilet or urinal, and a plurality of sanitary cubicles 51 can be arranged in a row, whereby these cubicles can be positively and non-positively connected to one another on each vertical side by means of the stationary stay pipes 3.

Examples of glass doors in which the present invention may be utilized or adapted for use in the context of the present invention may be disclosed in the following patents: U.S. Pat. No. 4,956,954 entitled, "Doorway System for Glass Doors and Method of Installation;" U.S. Pat. No. 5,009,080, entitled "Low-temperature Show Case;" U.S. Pat. No. 5,069,010, entitled "Glass Door or Partition Support Rail;" U.S. Pat. No. 5,148,630, entitled "Security Assembly for a Sliding Glass Door;" and Federal Republic of Germany Patent No. G 92 09 276.4.

Examples of glass walls and glass panels in which the present invention may be utilized or adapted for use in the context of the present invention may be disclosed in the following patents: U.S. Pat. No. 5,069,512 entitled, "Display Cabinets;" U.S. Pat. No. 4,898,355, entitled "Shelf Support for Glass Shelving;" and U.S. Pat. No. 5,092,087, entitled "Skylight framework."

Examples of panel connections in which the present invention may be utilized or adapted for use in the context of the present invention may be disclosed in the following patents: U.S. Pat. No. 5,323,577 entitled, "Adjustable Panel Mounting Clip;" U.S. Pat. No. 5,404,684, entitled "Method and Apparatus for Joining Panels;" U.S. Pat. No. 5,291,708, entitled "Modular Framing Systems;" and U.S. Pat. No. 5,363,616, entitled "Adjustable Corner Mullion for Joining Building Panels."

Examples of construction systems in which the present invention may be utilized or adapted for use in the context of the present invention may be disclosed in the following patents: U.S. Pat. No. 5,459,966 entitled, "Prefabricated Bathroom Walls;" U.S. Pat. No. 5,438,713, entitled "Seamless Bathroom Module for a Marine Vessel;" U.S. Pat. No. 5,437,065, entitled "Booths for Toilets;" U.S. Pat. No. 5,444,945, entitled "Wall Paneling System;" and U.S. Pat. No. 5,406,760, entitled "Modular Office Furniture Partition."

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application Nos. DE 295 20 098.7, filed on Dec. 19, 1995; DE 295 18 699.2, filed on Nov. 24, 1995; DE 295 20 099.5, filed on Dec. 19, 1995; DE 295 18 674.7, filed on Nov. 24, 1995; DE 295 18 450.7, filed on Nov. 23, 1995; and DE 195 43 611.3, filed on Nov. 23, 1995, having inventors Prof. Wolf Gerischer and Angela Oedekoven-Gerischer, and DE-OS DE 295 20 098.7, filed on Dec. 19, 1995; DE 295 18 699.2, filed on Nov. 24, 1995; DE 295 20 099.5, filed on Dec. 19, 1995; DE 295 18 674.7, filed on Nov. 24, 1995; DE 295 18 450.7, filed on Nov. 23, 1995; and DE 195 43 611.3, filed on Nov. 23, 1995 and DE-PS DE 295 20 098.7, filed on Dec. 19, 1995; DE 295 18 699.2, filed on Nov. 24, 1995; DE 295 20 099.5, filed on Dec. 19, 1995; DE 295 18 674.7, filed on Nov. 24, 1995; DE 295 18 450.7, filed on Nov. 23, 1995; and DE 195 43 611.3, filed on Nov. 23, 1995, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the a novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. An interior construction system for a rest room, said interior construction system comprising:

a plurality of wall elements;

said plurality of wall elements being configured to be disposed in a rest room to permit a user of a rest room to be at least partially isolated from other users of a rest room;

a plurality of support elements;

said plurality of support elements being configured to be disposed in a rest room to provide support for said plurality of wall elements;

a plurality of fastening elements;

said plurality of fastening elements being configured to operatively connect at least one of said plurality of wall elements to a corresponding support element upon installation of said plurality of fastening elements in a rest room;

at least one profile;

said at least one profile being configured to operatively connect to a corresponding one of said plurality of support elements;

said at least one profile being configured to at least partially conceal said corresponding support element, said plurality of fastening elements and a portion of said at least one of said plurality of wall elements from view of a user in a rest room upon installation of said at least one profile in a rest room;

said at least one profile comprising a sealing arrangement;

said sealing arrangement being configured to contact said at least one of said plurality of wall elements to form a seal to limit passage of liquids present in a rest room between said at least one profile and said at least one of said plurality of wall elements;

a plurality of installation members to permit mounting of said plurality of fastening elements on said plurality of support elements;

each of said plurality of installation members being configured to be disposed about a corresponding support element; and said plurality of fastening elements being configured to be connected to said plurality of installation members.

2. The interior construction system according to claim 1, wherein:

said at least one profile comprises a first surface and a second surface disposed opposite to said first surface;

said first surface of said at least one profile being configured to be disposed to face said corresponding support element of said at least one profile;

said at least one profile comprises an arrangement to permit mounting of one of said plurality of wall elements on said at least one profile; and said mounting arrangement being configured to be disposed on said second surface of said at least one profile.

3. The interior construction system according to claim 2, wherein:

each of said plurality of wall elements comprises an edge;

said interior construction system comprises a plurality of edge profiles;

each of said plurality of edge profiles is configured to be disposed on at least a portion of said edge of a corresponding wall element; and each of said plurality of edge profiles is disposed to contact said sealing arrangement to form a seal between said at least one profile and each of said plurality of edge profiles.

4. The interior construction system according to claim 1, further comprising:

at least one cubicle;

said at least one cubicle comprising:

a first wall segment;

said first wall segment being a first one of said plurality of wall elements;

said first wall segment comprising a first edge and a second edge disposed opposite to said first edge;

a second wall segment;

said second wall segment being a second one of said plurality of wall elements;

said second wall segment being configured to be connected to said first edge of said first wall segment;

a third wall segment;

said third wall segment being a third one of said plurality of wall elements; and said third wall segment being configured to be connected to said second edge of said first wall segment;

said plurality of support elements comprising a first support element and a second support element;

said first support element and said second support element being configured to be disposed a substantial distance from one another;

said second wall segment being configured to be connected to said first support element;

said third wall segment being configured to be connected to said second support element;

said at least one cubicle comprising a door frame;

said door frame being configured to be disposed between said first support element and said second support element;

said door frame being configured to be operatively connected to said first support element and said second support element;

said door frame comprising a rail segment;

said rail segment being configured to extend along said door frame;

said rail segment being configured to be disposed a substantial distance from a floor of a rest room;

said at least one cubicle comprising a first door member;

said first door member being configured to be attached in a substantially stationary position to said door frame;

said at least one cubicle comprising a second door member;

said second door member being configured to be operatively connected to said door frame; and said second door member being configured to move in said rail segment to permit said second door member to be moved relative to said first door member.

5. The interior construction system according to claim 4, wherein:

said second door member is configured to be disposed in one of a) and b):

a) a first position relative to said first door member to permit a user to enter said at least one cubicle; and b) a second position relative to said first door member to limit entry of a user into said at least one cubicle;

said at least one cubicle comprises an electrical drive mechanism;

said electrical drive mechanism is configured to be disposed to move said second door member between said first position and said second position;

said electrical drive mechanism comprises an electronic regulation system to control operation of said electrical drive mechanism; and said electronic regulation system comprises an arrangement to limit the force said electrical drive mechanism applies to said second door member in moving said second door member between said first position and said second position.

6. The interior construction system according to claim 5, wherein:

said electronic regulation system comprises a sensor apparatus;

said sensor apparatus is configured to send a signal to said electrical drive mechanism to move said second door member into said first position in response to a user being outside said at least one cubicle;

said electronic regulation system is configured to move said second door member into the closed position in response to a user entering said at least one cubicle; and said sensor apparatus is configured to be inactive in response to a user occupying said at least one cubicle.

7. The interior construction system according to claim 6, wherein:

each of said plurality of wall elements comprises at least one hole;

each of said plurality of fastening elements comprises a first member;

said first member of each of said plurality of fastening elements is operatively connected to one of said plurality of installation members;

said first member of each of said plurality of fastening elements is disposed to extend through said at least one hole of a corresponding wall element;

each of said plurality of fastening elements comprises a second member;

said second member of each of said plurality of fastening elements is configured to connect to a corresponding first member to secure said corresponding wall element of said first member between said first member and said second member to operatively connect said corresponding wall element of said first member to said corresponding support element of said plurality of fastening elements;

said at least one profile has a substantially curved cross sectional shape;

said at least one profile comprises an arcuate member;

said arcuate member comprising a first end and a second end disposed opposite to said first end;

said first end of said arcuate member being disposed substantially adjacent to said at least one of said plurality of wall elements;

said first end of said arcuate member comprises an extension;

said extension of said first end of said arcuate member is disposed on said first surface of said at least one profile;

said first end of said arcuate member comprises a recess;

said second end of said arcuate member comprises an extension;

said extension of said second end of said arcuate member is disposed on said first surface of said at least one profile;

said second end of said arcuate member comprises a recess;

said sealing arrangement comprises a first seal and a second seal;

said first seal is configured to be disposed in said recess of said first end of said arcuate member;

said second seal is configured to be disposed in said recess of said second end of said arcuate member;

said at least one profile comprises a connecting arrangement to connect said at least one profile to said corresponding support element of said at least one profile;

said connecting arrangement is configured to extend from said arcuate member towards said corresponding support element of said at least one profile;

each of said plurality of wall elements comprises glass;

each of said plurality of wall elements have one of a substantially planar shape and a substantially curved shape; and each of said plurality of support elements comprises a stay pipe.

8. The interior construction system according to claim 7, wherein:

said at least one cubicle is configured as one of a shower, stall, a changing room, a toilet, and a urinal;

said at least one cubicle comprises a plurality of cubicles;

said plurality of cubicles are configured to be disposed in a row;

said second wall segment of one of said plurality of cubicles is configured to be disposed adjacent to said third wall segment of another of said plurality of cubicles; and said plurality of support elements are configured to be disposed to connect said plurality of cubicles to one another.

9. The interior construction system according to claim 8, wherein:

each of said plurality of wall elements comprise a first side and a second side disposed opposite to said first side;

said first side of each of said plurality of wall elements is configured to be disposed adjacent to one of said plurality of support elements;

at least one of said plurality of wall elements comprises a first opening;

said first opening is configured to permit a utility line to pass from said first side of said at least one of said plurality of wall elements to said second side of said at least one of said plurality of wall elements;

said interior construction system comprises at least one of a sink, a console, a soap dispenser and at least one faucet;

said at least one of a sink, a console, a soap dispenser and at least one faucet is configured to be disposed adjacent to said second side of a corresponding wall element;

said corresponding wall element of said at least one of a sink, a console, a soap dispenser and at least one faucet comprises a second opening;

said second opening is configured to connect said at least one of a sink, a console, a soap dispenser and at least one faucet to a utility line adjacent to said first side of said corresponding wall element of said at least one of a sink, a console, a soap dispenser and at least one faucet;

said interior construction system comprises a lighting arrangement;

said lighting arrangement is configured to be disposed adjacent to said first side of one of said plurality of wall elements;

said lighting arrangement is configured to provide an indirect source of illumination to a user in a restroom;

said connecting arrangement comprises one of a screw connection, a plug-in connection and a clip connection;

said glass of said plurality of wall elements comprises structured glass; and each of said plurality of wall elements is configured to have a pattern printed on at least one of said first side and said second side to make each of said plurality of wall elements substantially opaque.

10. An interior construction system for a rest room, said interior construction system comprising:

a plurality of wall elements;

said plurality of wall elements being disposed in a rest room to permit a user of a rest room to be at least partially isolated from other users of a rest room;

each of said plurality of wall elements comprising at least one hole;

a plurality of support elements;

said plurality of support elements being disposed in a rest room to provide support for said plurality of wall elements disposed in a rest room;

a plurality of fastening elements;

said plurality of fastening elements being operatively connected to said plurality of support elements;

each of said plurality of fastening elements being disposed to extend through said at least one hole of a corresponding wall element to operatively connect said corresponding wall element to one of said plurality of support elements;

at least one profile;

said at least one profile being disposed in a rest room to at least partially conceal a corresponding support element from the view of a user in a rest room;

said at least one profile comprising a connecting arrangement to connect said at least one profile to its corresponding support element;

said at least one profile being configured to conceal said connecting arrangement from the view of a user in a rest room; and said at least one profile comprising:

a first leg portion;

said first leg portion being disposed adjacent to said one of said plurality of support elements;

said first leg portion comprising a first recess;

said connecting arrangement being disposed within said first recess of said first leg portion;

a second leg portion;

said second leg portion being disposed to extend away from said first leg portion in a first direction;

said second leg portion comprising an end;

said end of said second leg portion being disposed opposite to said first leg portion;

said end of said second leg portion comprising a second recess;

a first seal to seal against liquids present in a rest room;

said first seal being disposed within said second recess;

a third leg portion;

said third leg portion being disposed to extend away from said first leg portion in a second direction;

said second direction being substantially opposite to said first direction;

said third leg portion comprising an end;

said end of said third leg portion being disposed opposite to said first leg portion;

said end of said third leg portion comprising a third recess;

a second seal to seal against liquids present in a rest room; and said second seal being disposed within said third recess.

11. The interior construction system according to claim 10, comprising:

a plurality of installation members to mount said plurality of fastening elements on said plurality of support elements;

each of said plurality of installation members being disposed about a corresponding support element;

said plurality of fastening elements being connected to said plurality of installation members; and said at least one profile being configured and disposed to conceal said plurality of fastening elements and a portion of said corresponding wall element of said plurality of fastening elements from the view of a user in a rest room.

12. The interior construction system according to claim 11, wherein:

each of said plurality of wall elements comprises glass;

each of said plurality of wall elements has one of a substantially planar shape and a substantially curved shape;

each of said plurality of support elements comprises a stay pipe;

each of said plurality of fastening elements comprises a first member;

said first member of each of said plurality of fastening elements is operatively connected to a corresponding one of said plurality of installation members;

said first member of each of said plurality of fastening elements is disposed to extend through said at least one hole of said corresponding wall element of each of said plurality of fastening elements;

each of said plurality of fastening elements comprises a second member;

said second member of each of said plurality of fastening elements is configured to connect to a corresponding first member to clamp said corresponding wall element of each of said plurality of fastening elements between said first member and said second member to operatively connect said corresponding wall element of each of said plurality of fastening elements to a corresponding support element;

said at least one profile has a substantially curved cross sectional shape;

at least one of said first seal and said second seal is disposed to contact a wall element corresponding to each of said plurality of fastening elements;

said end of said second leg portion comprises an extension disposed adjacent to said corresponding support element of said at least one profile;

said end of said third leg portion comprises an extension disposed adjacent to said corresponding support element of said at least one profile; and said connecting arrangement is configured to connect said at least one profile to said corresponding support element of said at least one profile.

13. The interior construction system according to claim 12, wherein:

said at least one profile comprises an arrangement to mount one of said plurality of wall elements on said at least one profile;

each of said plurality of wall elements comprises an edge;

said interior construction system comprises a plurality of edge profiles;

each of said plurality of edge profiles is disposed on said edge of a corresponding wall element;

each of said plurality of edge profiles is disposed to contact at least one of said first seal and said second seal to form a seal between said at least one profile and said plurality of edge portions;

said connecting arrangement comprises one of a screw connection, a plug-in connection and a clip connection; and said connecting arrangement is configured to connect said at least one profile to said installation member disposed on said corresponding support element of said at least one profile.

14. The interior construction system according to claim 12, wherein:

said glass of said plurality of wall elements comprises structured glass;

said interior construction system comprises at least one cubicle;

said at least one cubicle comprises:

a first wall segment;

said first wall segment comprises a first one of said plurality of wall elements;

said first wall segment comprises a first edge and a second edge disposed opposite to said first edge;

a second wall segment;

said second wall segment comprises a second one of said plurality of wall elements;

said second wall segment is connected to said first edge of said first wall segment;

a third wall segment;

said third wall segment comprises a third one of said plurality of wall elements; and said third wall segment is connected to said second edge of said first wall segment;

said plurality of support elements comprises a first support element and a second support element;

said first support element and said second support element are disposed a substantial distance from one another;

said second wall segment is operatively connected to said first support element;

said third wall segment is operatively connected to said second support element;

said at least one cubicle comprises a door frame;

said door frame is disposed between said first support element and said second support element;

said door frame is operatively connected to said first support element and said second support element;

said door frame comprises a rail segment;

said rail segment is configured to extend along said door frame;

said at least one cubicle comprises a first door member;

said first door member is attached in a stationary position to said door frame;

said at least one cubicle comprises a second door member;

said second door member is operatively connected to said door frame;

said second door member is configured and disposed to move in said rail segment to permit said second door member to move relative to said first door member;

said at least one cubicle comprises a plurality of brackets;

said plurality of brackets is configured to connect said first wall segment to said second wall segment and said third wall segment;

said at least one cubicle comprises a plurality of fasteners;

said plurality of fasteners is configured to connect said second wall segment to said first support element and to connect said third wall segment to said second support element;

said second door member is configured to be disposed in one of a) and b):

a) a first position relative to said first door member to permit a user to enter said at least one cubicle; and b) a second position relative to said first door member to limit entry of a user into said at least one cubicle;

said at least one cubicle comprises an electrical drive mechanism;

said electrical drive mechanism is configured and disposed to move said second door member between said first position and said second position;

said electrical drive mechanism comprises an electronic regulation system to control operation of said electrical drive mechanism;

said electronic regulation system comprises a sensor apparatus;

said sensor apparatus is configured to send a signal to said electrical drive mechanism to move said second door member into said first position in response to a user being outside said at least one cubicle;

said electronic regulation system is configured to move said second door member into said second position in response to a user entering said at least one cubicle;

said sensor apparatus is configured to be inactive in response to a user occupying said at least one cubicle;

said electronic regulation system comprises an arrangement to limit the force said electrical drive mechanism applies to said second door member in moving said second door member between said first position and said second position;

each of said plurality of wall elements comprise a first side and a second side disposed opposite to said first side;

said first side of each of said plurality of wall elements is disposed adjacent to one of said plurality of support elements;

at least one of said plurality of wall elements comprises a first opening;

said first opening is configured to permit at least one of a utility line and a lighting component to pass from said first side of said at least one of said plurality of wall elements to said second side of said at least one of said plurality of wall elements;

said interior construction system comprises at least one of a sink, a console, a soap dispenser and at least one faucet;

said at least one of a sink, a console, a soap dispenser and at least one faucet is disposed adjacent to said second side of a corresponding wall element;

said corresponding wall element of said at least one of a sink, a console, a soap dispenser and at least one faucet comprises a second opening;

said second opening is configured to connect said at least one of a sink, a console, a soap dispenser and at least one faucet to a utility line adjacent to said first side of said corresponding wall element of said at least one of a sink, a console, a soap dispenser and at least one faucet;

said interior construction system comprises a lighting arrangement;

said lighting arrangement is disposed adjacent to said first side of one of said plurality of wall elements;

said lighting arrangement is configured to supply an indirect source of illumination for a user in a restroom;

said at least one cubicle is configured as one of a shower stall, a changing room, a toilet, and a urinal;

said at least one cubicle comprises a plurality of cubicles;

said plurality of cubicles are disposed in a row;

said second wall segment of one of said plurality of cubicles is disposed adjacent to said third wall segment of another of said plurality of cubicles;

said plurality of support elements are disposed to connect said plurality of cubicles to one another; and each of said plurality of wall elements is configured to have a pattern printed on one of said first side and said second side to make each of said plurality of wall elements substantially opaque.

15. An interior construction system for a rest room, said interior construction system comprising:

a plurality of wall elements;

said plurality of wall elements being configured to be disposed in a rest room to permit a user of a rest room to be at least partially isolated from other users of a rest room;

a plurality of support elements;

said plurality of support elements being configured to be disposed in a rest room to provide support for said plurality of wall elements;

a plurality of fastening elements;

said plurality of fastening elements being configured to operatively connect at least one of said plurality of wall elements to a corresponding support element upon installation of said plurality of fastening elements in a rest room;

at least one profile;

said at least one profile being configured to at least partially cover a corresponding support element, said plurality of fastening elements and a portion of said at least one of said plurality of wall elements from view of a user in a rest room upon installation of said at least one profile in a rest room;

said at least one profile comprising a first portion;

said first portion of said at least one profile being configured to extend towards said corresponding support element of said at least one profile;

said first portion of said at least one profile being configured to operatively connect said at least one profile to said corresponding support element of said at least one profile;

said at least one profile comprising at least one second portion;

said at least one second portion of said at least one profile being configured to extend from said first portion of said at least one profile towards said at least one of said plurality of wall elements;

said at least one profile comprising at least one seal;

said at least one seal being configured to be disposed to contact said at least one second portion of said at least one profile and said at least one of said plurality of support elements;

said at least one seal being configured to limit penetration of liquids present in a rest room between said at least one second portion of said at least one profile and said at least one of said plurality of wall elements;

at least one cubicle;

said at least one cubicle comprising:

a first wall segment;

said first wall segment being a first one of said plurality of wall elements;

said first wall segment comprising a first edge and a second edge disposed opposite to said first edge;

a second wall segment;

said second wall segment being a second one of said plurality of wall elements;

said second wall segment being configured to be connected to said first edge of said first wall segment;

a third wall segment;

said third wall segment being a third one of said plurality of wall elements; and said third wall segment being configured to be connected to said second edge of said first wall segment;

said plurality of support elements comprising a first support element and a second support element;

said first support element and said second support element being configured to be disposed a substantial distance from one another;

said second wall segment being configured to be connected to said first support element;

said third wall segment being configured to be connected to said second support element;

said at least one cubicle comprising a door frame;

said door frame being configured to be disposed between said first support element and said second support element;

said door frame being configured to be operatively connected to said first support element and said second support element;

said door frame comprising a rail segment;

said rail segment being configured to extend along said door frame;

said at least one cubicle comprising a first door member;

said first door member being configured to be attached in a substantially stationary position to said door frame;

said at least one cubicle comprising a second door member;

said second door member being configured to be operatively connected to said door frame;

said second door member being configured to move in said rail segment of said door frame to permit said second door member to be moved relative to said first door member;

said second door member being configured to be disposed in one of a) and b):

a) a first position relative to said first door member to permit a user to enter said at least one cubicle; and b) a second position relative to said first door member to limit entry of a user into said at least one cubicle;

said at least one cubicle comprising an electrical drive system;

said electrical drive system being configured to be disposed to move said second door member between said first position and said second position;

said electrical drive system comprising an electronic regulation system to control operation of said electrical drive mechanism;

said electronic regulation system comprising a sensor apparatus;

said sensor apparatus being configured to send a signal to said electrical drive system to move said second door member into said first position in response to a user being outside of said at least one cubicle;

said electronic regulation system being configured to move said second door member into said second position in response to a user entering said at least one cubicle;

said sensor apparatus being configured to be inactive in response to a user occupying said at least one cubicle; and said electronic regulation system comprising an arrangement to limit the force said electrical drive mechanism applies to said second door member in moving said second door member between said first position and said second position.

16. The interior construction system according to claim 15, wherein:

each of said plurality of wall elements comprises a first side and a second side disposed opposite to said first side;

said first side of each of said plurality of wall elements is configured to be disposed substantially adjacent to one of said plurality of support elements;

at least one of said plurality of wall elements comprises a first opening;

said first opening is configured to permit a utility line to pass from said first side of said at least one of said plurality of wall elements to said second side of said at least one of said plurality of wall elements;

said interior construction system comprises at least one of a sink, a console, a soap dispenser and at least one faucet;

said at least one of a sink, a console, a soap dispenser and at least one faucet is configured to be disposed adjacent to said second side of a corresponding wall element;

said wall element corresponding to said at least one of a sink, a console, a soap dispenser and at least one faucet comprises a second opening;

said second opening is configured to connect said at least one of a sink, a console, a soap dispenser and at least one faucet to a utility line adjacent to said first side of said corresponding wall element of said at least one of a sink, a console, a soap dispenser and at least one faucet;

said interior construction system comprises a lighting arrangement; and said lighting arrangement is configured to be disposed adjacent to said first side of said plurality of wall elements.

17. The interior construction system according to claim 16, wherein:

said interior construction system comprises a plurality of installation members to permit mounting of said plurality of fastening elements on said plurality of support elements;

each of said plurality of installation members are configured to be disposed about a corresponding support element;

each of said plurality of wall elements comprises at least one hole;

each of said plurality of fastening elements comprises a first member;

said first member is configured to be operatively connected to one of said plurality of installation members;

said first member is configured to be disposed to extend through said at least one hole of a corresponding wall element;

each of said plurality of fastening elements comprises a second member;

said second member is configured to connect to said first member to clamp said corresponding wall element of said first member between said first member and said second member to connect said corresponding wall element of said first member to said corresponding support element of said plurality of fastening elements;

said at least one profile has a substantially curved cross sectional shape;

said at least one profile comprises a first surface and a second surface disposed opposite said first surface;

said first surface of said at least one profile being configured to be disposed to face said corresponding support element of said at least one profile;

said at least one second portion of said at least one profile comprises an end configured to be disposed opposite to said first portion;

said end of said at least one second portion of said at least one profile has an enlarged cross sectional shape adjacent to said first surface of said at least one profile;

said end of said at least one second portion of said at least one profile comprises a recess;

said at least one seal being configured to be disposed in said recess of said end of said at least one second portion of said at least one profile;

said at least one profile comprises an arrangement to permit mounting of one of said plurality of wall elements on said at least one profile;

said mounting arrangement being configured to be disposed on said second surface of said at least one profile;

said first portion of said at least one profile comprises a connecting arrangement to connect said at least one profile to said corresponding support element of said at least one profile;

said connecting arrangement comprises one of a screw connection, a plug-in connection and a clip connection;

said connecting arrangement is configured to connect said at least one profile to said installation member disposed on said corresponding support element of said at least one profile;

said at least one cubicle comprises a plurality of brackets;

said plurality of brackets is configured to be disposed to connect said second wall segment and said third wall segment to said first wall segment;

said at least one cubicle comprises a plurality of fasteners;

said plurality of fasteners is configured to connect said second wall segment to said first support element and to connect said third wall segment to said second support element;

said at least one cubicle is configured as one of a shower stall, a changing room, a toilet, and a urinal;

said at least one cubicle comprises a plurality of cubicles;

said plurality of cubicles are configured to be disposed in a row;

said second wall segment of one of said plurality of cubicles is configured to be disposed adjacent to said third wall segment of another of said plurality of cubicles;

said plurality of support elements are configured to be disposed to positively and non-positively connect said plurality of cubicles to one another;

each of said plurality of wall elements comprises an edge;

said interior construction system comprises a plurality of end pieces;

each of said plurality of end pieces is configured to be disposed on a portion of said edge of a corresponding wall element;

each of said plurality of end pieces is disposed to contact said at least one seal to form a seal between said at least one profile and said plurality of end pieces;

each of said plurality of wall elements comprises structured glass;

each of said plurality of wall elements is configured to have a pattern printed on at least one of said first side and said second side;

each of said plurality of wall elements has one of a substantially planar shape and a substantially curved shape;

each of said plurality of support elements comprises a stay pipe; and said lighting arrangement is configured to supply an indirect source of illumination.

* * * * *

UNITED STATES PATENT AND TRADEMARK OFFICE

CERTIFICATE OF CORRECTION

PATENT NO. : 5,937,599

DATED : August 17, 1999

INVENTOR(S) : Wolf GERISCHER and Angela OEDEKOVEN-GERISCHER

It is certified that error appears in the above-identified patent and that said Letters Patent is hereby corrected as shown below:

In column 28, line 20, Claim 17, after 'to' delete "positively and non-positively".

Signed and Sealed this

Twenty-fifth Day of July, 2000

*Attest:*

*Attesting Officer*

Q. TODD DICKINSON

*Director of Patents and Trademarks*